US005870953A

United States Patent [19]

Winston

[11] Patent Number: 5,870,953

[45] Date of Patent: Feb. 16, 1999

[54] INK PAD ASSEMBLIES WITH INTERCHANGEABLE INK-IMPREGNATED PADS

[76] Inventor: Jeffrey M. Winston, 658 W. Shore Dr., Anacortes, Wash. 98221

[21] Appl. No.: 871,610

[22] Filed: Jun. 9, 1997

Related U.S. Application Data

[63] Continuation-in-part of Ser. No. 465,468, Jun. 5, 1995, Pat. No. 5,636,569, which is a continuation of Ser. No. 258,468, Jun. 10, 1994, Pat. No. 5,505,130.

[51] Int. Cl.[6] ..... B41K 1/42

[52] U.S. Cl. ..... 101/333; 101/327

[58] Field of Search ..... 101/101, 104, 101/97, 108, 327, 333, 405, 406

[56] References Cited

U.S. PATENT DOCUMENTS

| | | |
|---|---|---|
| 200,389 | 2/1878 | Grinnan . |
| 209,763 | 11/1878 | Keeler . |
| D. 247,063 | 1/1978 | Funahashi . |
| D. 252,935 | 9/1979 | Henkels . |
| 321,223 | 6/1885 | Keeler . |
| D. 331,418 | 12/1992 | Winston . |
| 427,229 | 5/1890 | French . |
| 602,061 | 4/1898 | Echelberger . |
| 642,367 | 1/1900 | Phillips et al. . |
| 657,961 | 9/1900 | Roberts . |
| 749,034 | 1/1904 | Daut . |
| 829,230 | 8/1906 | Pope . |
| 848,063 | 3/1907 | Sommer . |
| 984,632 | 2/1911 | Winterbottom et al. . |
| 1,070,763 | 8/1913 | Bauman et al. . |
| 1,073,036 | 9/1913 | Fuchs . |
| 1,127,806 | 2/1915 | Pells et al. . |
| 1,173,092 | 2/1916 | Bickerton . |
| 1,255,925 | 2/1918 | Peters . |
| 1,291,057 | 1/1919 | Marks . |
| 1,463,718 | 7/1923 | Munson . |
| 1,512,085 | 10/1924 | Clary . |

(List continued on next page.)

FOREIGN PATENT DOCUMENTS

| | | |
|---|---|---|
| 1279095 | 11/1961 | France . |
| 2063565 | 7/1971 | France . |
| 2307659 | 11/1976 | France . |
| 8119720 | 10/1981 | France . |
| 231631 | 11/1909 | Germany . |
| 551219 | 5/1932 | Germany . |
| 551947 | 5/1932 | Germany . |
| 1259732 | 1/1968 | Germany . |
| 1960556 | 6/1971 | Germany . |
| 2115088 | 12/1972 | Germany . |
| 2455533 | 5/1975 | Germany . |
| 2606642 | 8/1977 | Germany . |
| 451645 | 9/1949 | Italy . |
| 151703 | 3/1932 | Switzerland . |
| 303222 | 11/1954 | Switzerland . |
| 4940 | of 1896 | United Kingdom . |
| 1560872 | 2/1980 | United Kingdom . |
| 2045687 | 11/1980 | United Kingdom . |

OTHER PUBLICATIONS

Marking Industry Magazine, Ad. by Clearsnap, Inc., May 1991.

Stamp Products Resource Book 1994–1995, Clearsnap, Inc., Anacortes, WA pp. 44, 48, 50.

*Primary Examiner*—Ren Yan

*Attorney, Agent, or Firm*—Michael R. Schacht; Hughes & Schacht, P.S.

[57] ABSTRACT

A multi-color ink pad assembly with end user configurable pad/plate assemblies. The pad/plate assemblies comprise an absorbent pad impregnated with ink attached to a rigid mounting plate. Attachment means are provided which engage the mounting plate to attach the pad/plate assemblies onto a base such that the user may manually remove and reattach the pad/plate assemblies to the base in any number of configurations. Two detent members are formed on the mounting plates and a hole is formed in the base. The detent members pass through the hole and engage the base to help avoid inadvertent removal of pad/plate assemblies from the base. The end user thus has tremendous flexibility in constructing multi-color inking surfaces.

19 Claims, 11 Drawing Sheets

U.S. PATENT DOCUMENTS

| | | | |
|---|---|---|---|
| 1,576,791 | 3/1926 | Rosner . | |
| 1,656,489 | 1/1928 | Low . | |
| 1,796,137 | 3/1931 | Baumgarten . | |
| 1,909,326 | 5/1933 | Wheeler, Jr. . | |
| 1,987,802 | 1/1935 | Ryan | 101/335 |
| 2,117,470 | 5/1938 | Zareko . | |
| 2,290,488 | 7/1942 | Munson . | |
| 2,367,083 | 1/1945 | Amis . | |
| 2,386,965 | 10/1945 | Lui | 101/108 |
| 2,408,860 | 10/1946 | Lindblad . | |
| 2,576,622 | 11/1951 | McBride et al. . | |
| 2,723,476 | 11/1955 | Lyon . | |
| 2,819,668 | 1/1958 | McAneny . | |
| 2,839,960 | 10/1958 | Bissonet . | |
| 3,096,713 | 7/1963 | McLaughlin, Jr. . | |
| 3,158,096 | 11/1964 | Arnold . | |
| 3,161,903 | 12/1964 | Worthington . | |
| 3,259,063 | 7/1966 | Rothman . | |
| 3,282,209 | 11/1966 | Muskin . | |
| 3,326,180 | 6/1967 | Lofgren . | |
| 3,403,623 | 10/1968 | Blackwood . | |
| 3,465,673 | 9/1969 | Oppenheim . | |
| 3,795,192 | 3/1974 | Robertson . | |
| 3,817,178 | 6/1974 | Hagen . | |
| 3,839,960 | 10/1974 | Bissonet . | |
| 3,859,915 | 1/1975 | Hunter . | |
| 3,948,173 | 4/1976 | Barasch . | |
| 3,973,495 | 8/1976 | Rowe . | |
| 4,004,376 | 1/1977 | Schepp et al. . | |
| 4,152,984 | 5/1979 | Utzinger . | |
| 4,181,560 | 1/1980 | Maitland . | |
| 4,221,164 | 9/1980 | Krulwich . | |
| 4,259,568 | 3/1981 | Dynesen . | |
| 4,367,965 | 1/1983 | Speitel et al. . | |
| 4,545,140 | 10/1985 | Winston . | |
| 4,553,476 | 11/1985 | Kirby, Jr. . | |
| 4,752,147 | 6/1988 | Persi . | |
| 4,817,526 | 4/1989 | Winston . | |
| 4,852,203 | 8/1989 | LaBelle . | |
| 4,986,175 | 1/1991 | Boehringer et al. . | |
| 4,996,735 | 3/1991 | Blankenship . | |
| 4,996,921 | 3/1991 | Hong . | |
| 5,313,885 | 5/1994 | Winston . | |

INK PAD ASSEMBLIES WITH INTERCHANGEABLE INK-IMPREGNATED PADS

RELATED APPLICATIONS

This is a Continuation-In-Part of U.S. Ser. No. 08/465,468, filed Jun. 5, 1995, now U.S. Pat. No. 5,636,569, which is a Continuation of U.S. Ser. No. 08/258,468, filed Jun. 10, 1994, now U.S. Pat. No. 5,505,130.

TECHNICAL FIELD

The present invention relates to ink pads used with rubber stamps and, more particularly, to ink-impregnated absorbent pads used in the art stamping field.

BACKGROUND OF THE INVENTION

The stamping industry is divided into two distinct fields the art stamping field and the industrial stamping field. In the industrial field, the impression to be formed usually comprises a single word or phrase formed in a single color. The paramount considerations in the design and manufacture of industrial ink stamps and related items are durability, consistency, and ease of use. The quality of ink impression, the flexibility of the ink stamp, and the ability to form ink impressions comprised of a plurality of colors are of minimal importance.

In the art stamping field, on the other hand, the goal is to form an artistic image. Therefore, the quality of the ink impression, flexibility of the stamping apparatus, and ability to form multi-color images are highly valued. Considerations of durability and ease of use are important, after aesthetic considerations.

Given the different goals underlying the use of ink stamps in the art stamping field and in the industrial stamping field, most products designed for use in one field are not appropriate for use in the other field. This division between the two stamping fields is accentuated by the difference in the marketing and distribution channels for the two sets of products: art stamping supplies are usually sold through art, hobby supply, or gift stores, while industrial stamping supplies are usually available in office supply outlets.

The present invention is particularly effective when used in the field of art stamping. As briefly mentioned above, in the art stamping field it is highly desirable to form a single image ink impression in which the ink impression comprises two or more colors.

The transfer of ink to a rubber stamp to obtain such multi-colored ink impressions can be performed in two basic ways. First, single color ink pads may be consecutively brought into contact with specific portions of a rubber stamp to obtain a desired color configuration on the rubber stamp. This method is described, for example, in the Applicant's copending U.S. patent application Ser. No. 08/224,071. Second, the ink pad itself may be made up of several colors of ink; the rubber stamp is brought into contact with the pad to transfer several colors of ink at one time. Examples of such multi-color ink pads are shown and described in U.S. Pat. Nos. Des. 331,418 and 4,817,526 issued to the present Applicant and commercially available from the Applicant under the trademark RUBBER STAMP PAINTBOX.

Ink pads have traditionally been supplied in single color configurations that comprise an ink-impregnated absorbent pad permanently glued onto a base and covered by a lid. These single color ink pads are traditionally rectangular but have been supplied in other configurations that enhance the end user's ability to apply ink onto the rubber stamp.

Multi-color ink pads are a more recent development and generally comprise a base, a number of discrete ink-impregnated absorbent pads permanently glued to the base at the factory, and a lid to cover the base. The discrete absorbent pads of the most popular ink pads are normally rectangular and are arranged edge to edge to form a rectangular inking surface. Some ink pads comprise discrete absorbent pads in shapes other than rectangular, although these ink pads having irregularly shaped absorbent pads are more limiting and not as popular as the rectangular ink pads.

Since approximately 1990, the Applicant of the present invention has produced and sold multi-color ink pads in which the colors in each of the ink pad configurations are coordinated and often arranged by theses such as "SPRING" or "CHRISTMAS". Many end users will collect several ink pad configurations and use the color configuration that is appropriate for a given ink image. Since their introduction, such ink pads have proven to be very successful in the marketplace and are currently available in dozens of color configurations. These ink pads are shown, for example, in U.S. Pat. No. Des. 331,418.

The cleaning and re-inking of such multi-color ink pads is not easy because colors tend to smudge from one individual absorbent pad to the absorbent pad adjacent thereto. However, both end users and manufacturers of art stamping equipment have been generally satisfied with the state of the art of ink pad design.

OBJECTS OF THE INVENTION

An important object of the present invention is to provide improved multi-color ink pads, methods of forming multi-color ink images, and methods of manufacturing and distributing multi-color ink pads.

Another important, but more specific, object of the present invention is to provide ink pads, ink image forming methods, and ink pad manufacturing methods having a favorable mix of the following factors:

a. allowing ink-impregnated absorbent pads to be removed from the base and used individually to place ink onto a stamp or to be cleaned or re-inked;

b. allowing ink-impregnated absorbent pads to be mounted in various configurations on a base and used by bringing the rubber stamp into contact with the absorbent pads mounted on the base;

c. easily allowing more than one color of ink to be applied to a stamp;

d. may be simply, inexpensively, and automatically manufactured;

e. having an aesthetically pleasing shape;

f. eliminates the need for manufacturers to manufacture and hold in inventory specific multi-color ink pads in a number of pre-configured color arrangements; and g. allow manufacturers to assemble ink pad configurations to order in a practical and cost effective manner.

SUMMARY OF THE INVENTION

These and other objects are achieved by the present invention, which is a multi-color ink pad comprising a base, a plurality of pad/plate assemblies comprising a mounting member and an ink-impregnated absorbent pad, and attachment means for allowing manual attachment, detachment, and reattachment of the pad/plate assemblies onto the base.

This novel arrangement of separate, individual pad/plate assemblies manually attachable to the base provides improved functionality to the end user as well as substantial increases in manufacturing and distributing efficiencies to the manufacturer.

The end user benefits from the present invention for several reasons. First, the end user can buy one item that contains the functionality of both the single color ink pad and a multi-color ink pad: the pad/plate assemblies can be used individually like the prior art single color ink pads, and the pad/plate assemblies can be mounted onto the base to obtain a multi-color inking surface like that provided by prior art multi-color ink pads. This dual functionality of the present invention can be obtained while decreasing the difficulty of use over that provided by the prior art single use devices.

Second, the end user can mix and match colors as the end user desires and is not limited to the color configurations offered by the manufacturer. Thus, when used as a multi-color ink pad, the interchangeability of the pad/plate assemblies of the present invention provides more flexibility to the end user.

Third, when the end user wishes to clean or re-ink the ink pad, the end user may remove the individual pad/plate assemblies, clean and/or re-ink these assemblies, and replace them onto the base. This lessens the likelihood that colors will be smudged form one absorbent pad onto an adjacent absorbent pad.

Fourth, pad/plate assemblies of the same color can be grouped together to double, triple, or otherwise increase the size of the individual colors of the multi-color ink pads.

These capabilities referred to in the previous three paragraphs were unheard of with prior art multi-color ink pads and add great flexibility to the end user.

The ink pad manufacturer benefits from the present invention because the manufacturer need not maintain an inventory of multi-color ink pads in dozens of different color configurations. The manufacturer need only stock individual pad/plate assemblies and assemble these pad/plate assemblies into ink pads having color configurations ordered by the customer or distributor. This will lessen the likelihood that the manufacturer will have excess inventory of unpopular color configurations and insufficient inventory in popular color configurations.

A number of different attachment means may be provided to allow the individual pad/plate assemblies to be attached to the base. In general, the pad/plate assemblies will comprise a mounting plate onto which the absorbent pad is permanently affixed. When precise, repeatable alignment of pad/plate assemblies is required, the attachment means preferably comprises interacting tabs and projections, rails and slots, and/or pegs and holes. When a more free-form arrangement of pad/plate assemblies is desired, temporary adhesives or magnetic attachment assemblies may be used.

When slotting, keying, or peg systems are employed, the attachment means may use a universal attachment system to allow pad/plate assemblies to be exchanged from one base style to another, different, base style using the same universal attachment system.

The shapes of the pad/plate assemblies can vary significantly depending upon the color configuration desired by the end user. Perhaps the simplest and most generally effective shape is the rectangle. Using rectangles as building blocks, the pad/plate assemblies will form a square or rectangular inking surface with absorbent pads arranged in stripes that greatly facilitate the dabbing of ink onto the rubber stamp. Triangular or pie-shaped segments can be assembled into rectangular or circular inking surfaces with interesting effect. Further, numerous simple shapes such as triangles and squares can be used as building blocks to obtain more complex color configurations when peg and slot, adhesive, or magnetic attachment systems are used.

The present invention thus allows entirely new methods of selling and using ink pads. The individual pad/plate assemblies may be sold and collected apart from the completed multi-color ink pads, but can be at any time reassembled into color combinations that, because of sheer number of options involved, were impossible to obtain due to the limitations of prior art manufacturing and distribution methods.

DETAILED DESCRIPTION OF THE INVENTION

As briefly discussed above, a number of mechanical attachment systems may be used to realize the benefits of the present invention. Several of these mechanical systems will be individually discussed in further detail below.

I. PRESSURE FIT ATTACHMENT SYSTEM

Figure 1:
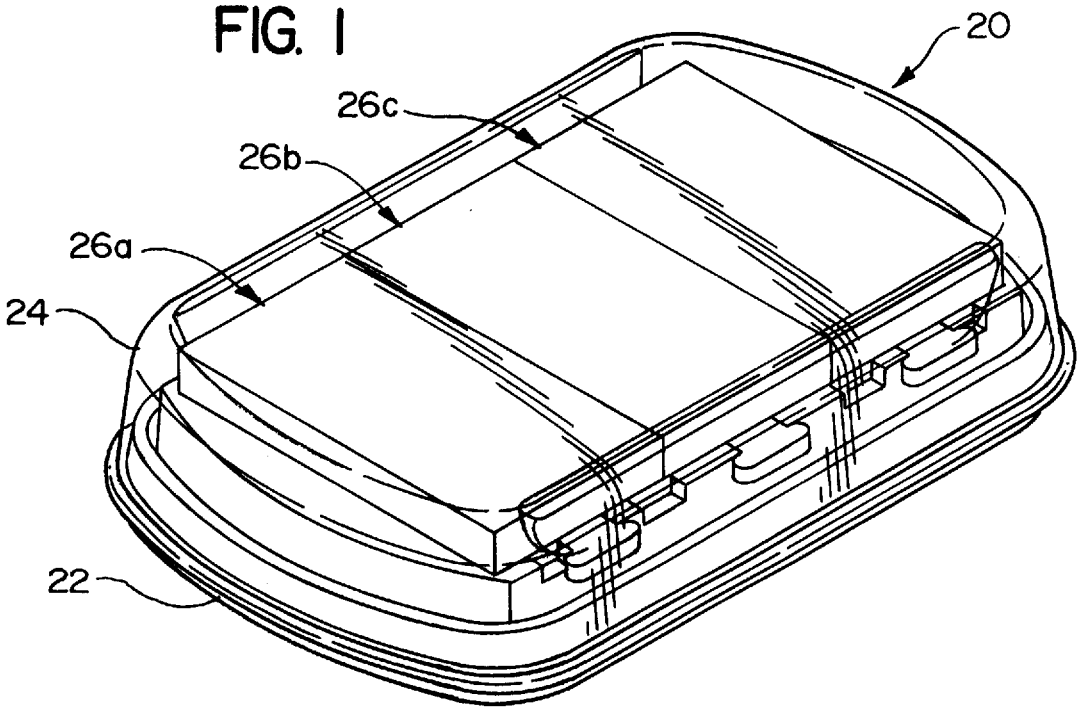
FIG. 1 is an isometric view of an ink pad constructed in accordance with, and embodying, the principles of a first embodiment of the present invention.
Figure 2:
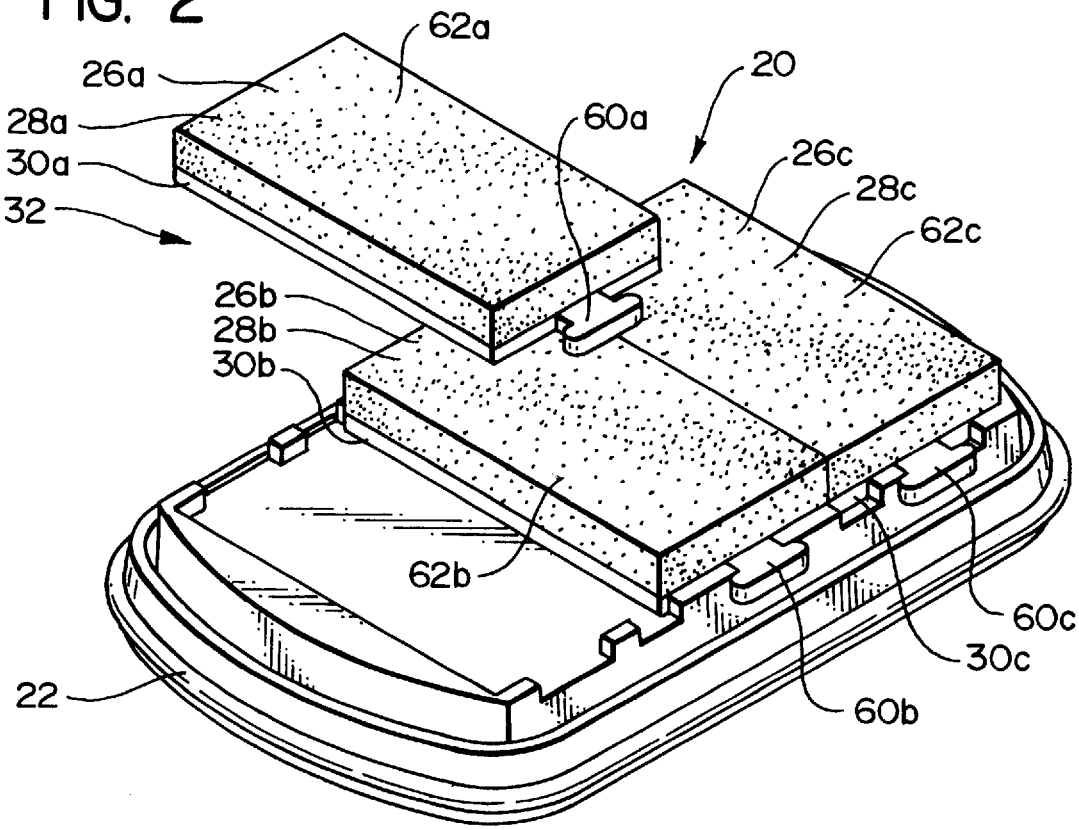
FIG. 2 is an isometric view of the ink pad shown in FIG. 1 with a cover thereof removed and showing the removability of the pad/plate assemblies forming a part thereof.

Turning now to the drawing, a first exemplary ink pad assembly constructed in accordance with the principles of the present invention is shown at 20 in FIG. 1. This ink pad assembly 20 basically comprises: (a) a base 22; (b) a lid 24; and (c) first, second, and third pad/plate assemblies 26*a–c*. Further, as shown in FIG. 2, each pad/plate assembly 26 comprises an ink-impregnated absorbent pad 28 and a mounting plate 30. Normally, but not necessarily, the absorbent pads 28*a–c* will be impregnated with different colors or ink.

Figure 7:
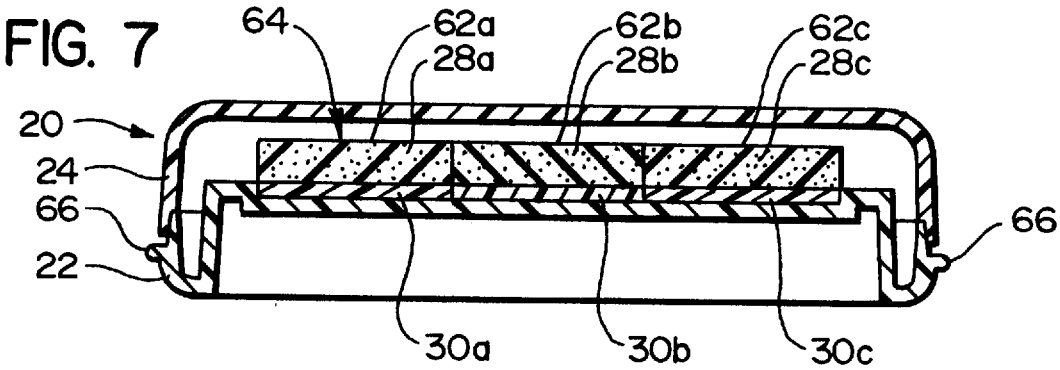
FIGS. 7 and 7A are side and end cut-away views, respectively, showing details of construction and operation of the ink pad shown in FIG. 1.

The ink pad assembly 20 further comprises an attachment system 32 comprising: (a) first through twelfth mounting projections 34–56 (FIG. 2) formed as part of the base 22; and (b) a pair of locking tabs 58 and 60 (FIG. 4) formed as part of each of the mounting plates 30. This attachment system 32 allows the pad/plate assemblies 26 to be manually attached to, manually detached from, and randomly reattached to the base 22. When the pad/plate assemblies 26*a–c* are attached to the base 22, the absorbent pads 28*a–c* abut each other such that upper surfaces 62*a–c* of the absorbent pads 28*a–c* form a substantially continuous and planar inking surface 64 as shown in FIGS. 4 and 7.

Figure 4:
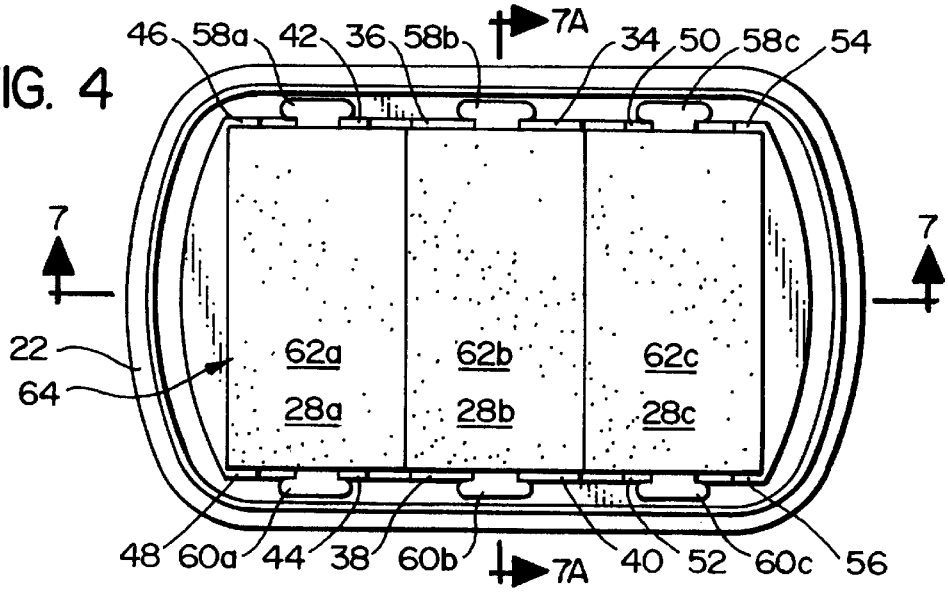

In particular, as shown in FIG. 4, the mounting projections 34, 36, 38 and 40 engage the locking tabs 58*b* and 60*b* to form a pressure fit that binds the pad/plate assembly 26*b* onto the base 22. To attach the pad/plate assembly 26*a* onto the base 22, a pressure fit is also formed by the engagement of the mounting projections 42 and 44 on the locking tabs 58*a* and 60*a* and of the mounting member 30*a* on the base 22. A similar pressure fit formed by the engagement of the mounting projections 50 and 52 on the locking tabs 58*c* and 60*c* and of the mounting member 30*c* on the base 22 attaches the pad/plate assembly 26*c* onto the base 22.

The pressure fits described above result form friction at three or four opposing points of contact between the mounting members 39 and the base 22 (or projections rigidly extending from this base 22). The frictional forces at these opposing points of contact maintain the pad/plate assemblies 26 on the base 22 under normal use conditions, but the end user may easily grip one or both of the locking tabs 58 and 60 and displace the pad/plate assemblies 26 away from the base 22, thereby overcoming these frictional forces and removing any of these assemblies 26 from the base 22.

Figure 32:
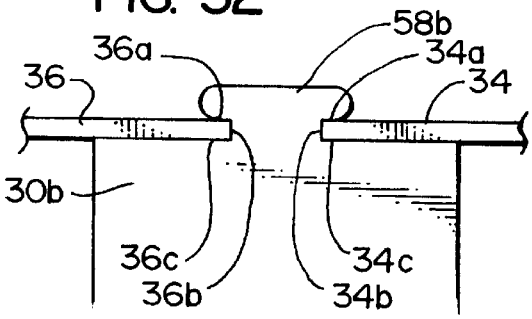
FIG. 32 depicts details of the mounting assembly employed to mount pad/plate assemblies of the ink pad assembly shown in FIG. 1 to the base portion of that ink pad assembly.

Referring for a moment to FIG. 32, the interaction of the tab 58*b* and mounting plate 30*b* with the mounting projections 34 and 36 is shown in further detail to illustrate how a pressure fit may be established to attach the pad/plate assemblies 26 onto the base 22. In particular, this pressure fit is developed by friction between surfaces on the tab 58*b* and the mounting projections 34 and 36 and the mounting plate 30*b* and the mounting projections 34 and 36 at the junctures identified as 34*a,b,c* and 36*a,b,c* in FIG. 32.

The base 22 and mounting plates 30 are preferably injection molded. Imperfections in the model, imperfections in the part that occur during the molding process, and temperature changes all result in a fit that is not perfect and which causes friction to develop between the surfaces that engage at the junctures 34*a–c* and 36*a–c*. This friction will inhibit, but not prevent when desired, movement of the pad/plate assemblies 26 relative to the base 22 when the assemblies 26 are attached to the base 22 as shown in FIG. 1.

Figure 7A:
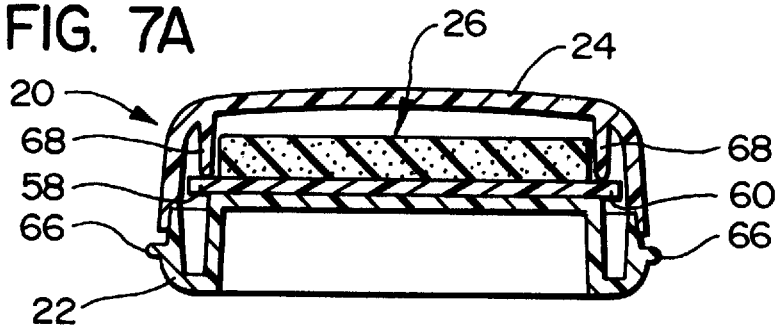

Referring now to FIGS. 7 and 7A, two additional features of the ink pad assembly 20 will be described. A peripheral ridge 66 extends around the periphery of the base 22. This ridge 66 provides the user with a secure grip on the base 22 to facilitate removal of the cover and manipulation of the base 22 when pad/plate assemblies 26 are attached and detached therefrom. Further, as perhaps best shown in FIG. 7A, a pair of stop ribs 68*b* are formed in the inside of the cover 24. When the cover 24 is attached to the base 22, these ribs 68 engage the tabs 58 and 60 of the pad/plate assemblies 26 to maintain these assemblies 26 on the base 22 even if the base 22 is dropped or otherwise jarred.

As described, the base 22, pad/plate assemblies 26, and attachment system 32 cooperate to allow the pad/plate assemblies 26 to be arranged in different configurations on the base 22. Thus, by rearranging the pad/plate assemblies 26*a–c*, the inking surface 64 can be comprised of three bands of color that can be configured in various arrangements as desired by the end user.

Importantly, as will be discussed in further detail below, each of these pad/plate assemblies 26 can be used individually to apply ink onto a rubber stamp. The pad/plate assemblies 26 are small and easily manipulated to allow precise application of ink on a rubber stamp. The base 22 will in this case be comparable to a palette and will not be directly involved in the process of applying ink to the rubber stamp. When using the pad/plate assemblies 26 individually, the tabs 58 and 60 thereof may be gripped to facilitate the handling thereof.

Figure 3:
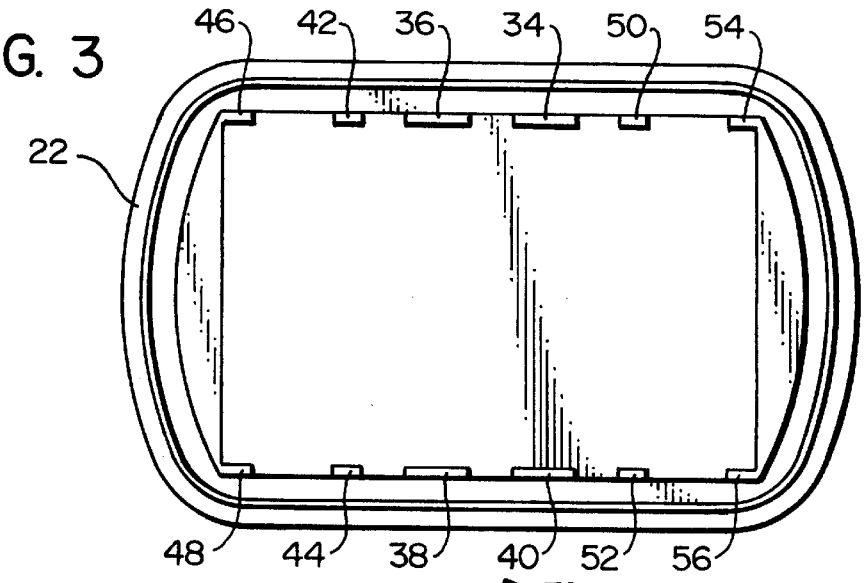
FIGS. 3–6 are top plan views showing the base portion of the ink pad assembly shown in FIG. 1 and various configurations of pad/plate assemblies mounted thereon.
Figure 5:
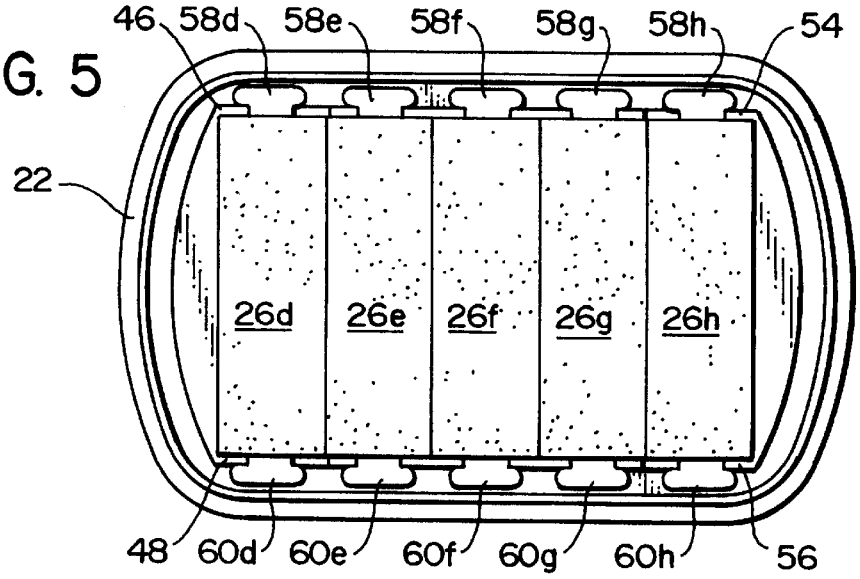

Further, the mounting projections 34–56 are spaced such that pad/plate assemblies 26 of differing widths can be mounted on the base 22. FIG. 5 depicts a situation in which five pad/plate assemblies 26*d*, 26*e*, 26*f*, 26*g*, and 26*h* are mounted on the base 22 described above. These pad/plate assemblies 26*d–h* are narrower than the pad/plate assemblies 26*a–c* described above but have similar locking tabs 58*d–h* and 60*d–h*. The base 22 shown in FIG. 5 is exactly the same as the base 22 shown in FIGS. 3 and 4, but only the mounting projections 46, 48, 54, and 56 are identified in FIG. 5 for purposes of clarity.

The pad/plate assemblies 26*e–g* are attached to the base 22 using a four contact point pressure fit similar to that employed by the pad/plate assembly 26*b* described above. To attach the pad/plate assembly 26*d* onto the base 22, a three-point pressure fit is formed by the engagement of the locking tabs 58*d* and 60*d* with the mounting projections 46 and 48 and of the mounting member 30*d* with the adjacent mounting member 30*e*. Similarly, the pad/plate assembly 26*h* is attached to the base 22 by a pressure fit resulting from the engagement of the locking tabs 58*h* and 60*h* with the mounting projections 54 and 56 and of the mounting member 30*h* with the adjacent mounting member 30*g*.

Using these narrower pad/plate assemblies 26*d–h*, the inking surface 44 is comprised of up to five bands of color; again, the pad/plate assemblies 26*d–h* can be of any color and configured in any arrangement of colors by the end user.

Figure 6:
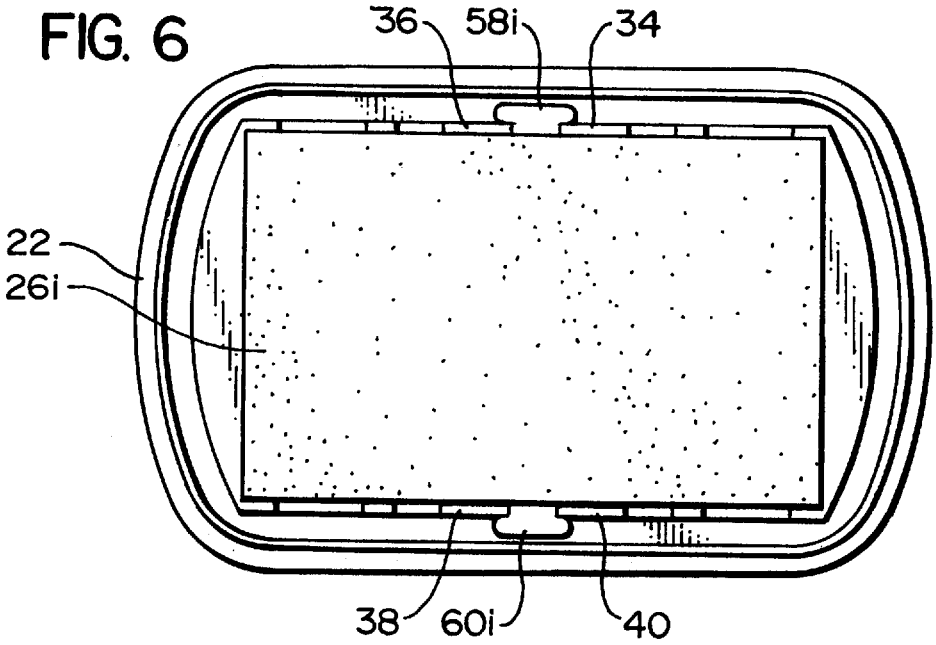

Yet another pad/plate assembly 26*i* is shown in FIG. 6. This pad/plate assembly 26*i* is much wider than any of the pad/plate assemblies 26*a–h* and only one such pad/plate assembly 26*i* can be mounted on the base 22. The pad/plate assembly 26*i* is attached to the base 22 by locking tabs 58*i* and 60*i* that engage the mounting projections 34, 36, 38 and 40 in a manner similar to that of the pad/plate assembly 26*b* described above. The inking surface 64 formed by the pad/plate assembly 26*i* will normally be a single color.

While the use of the single pad/plate assembly 26*i* obviously precludes the end user from configuring an inking surface 64 with several bands of color, in many circumstances a single color inking surface may be desired.

Further, the manufacturer can still manufacture multi-color inking surfaces in the form of a plurality of absorbent pads permanently mounted on a single mounting member. Thus, while providing all of the advantages of interchangeability of pad/plate assemblies described above, the ink pad assembly 20 can be manufactured, distributed, and used in a manner exactly the same as prior art multi-color ink pads when desired.

II. RAIL/FRICTION FIT ATTACHMENT SYSTEM

Figure 8:
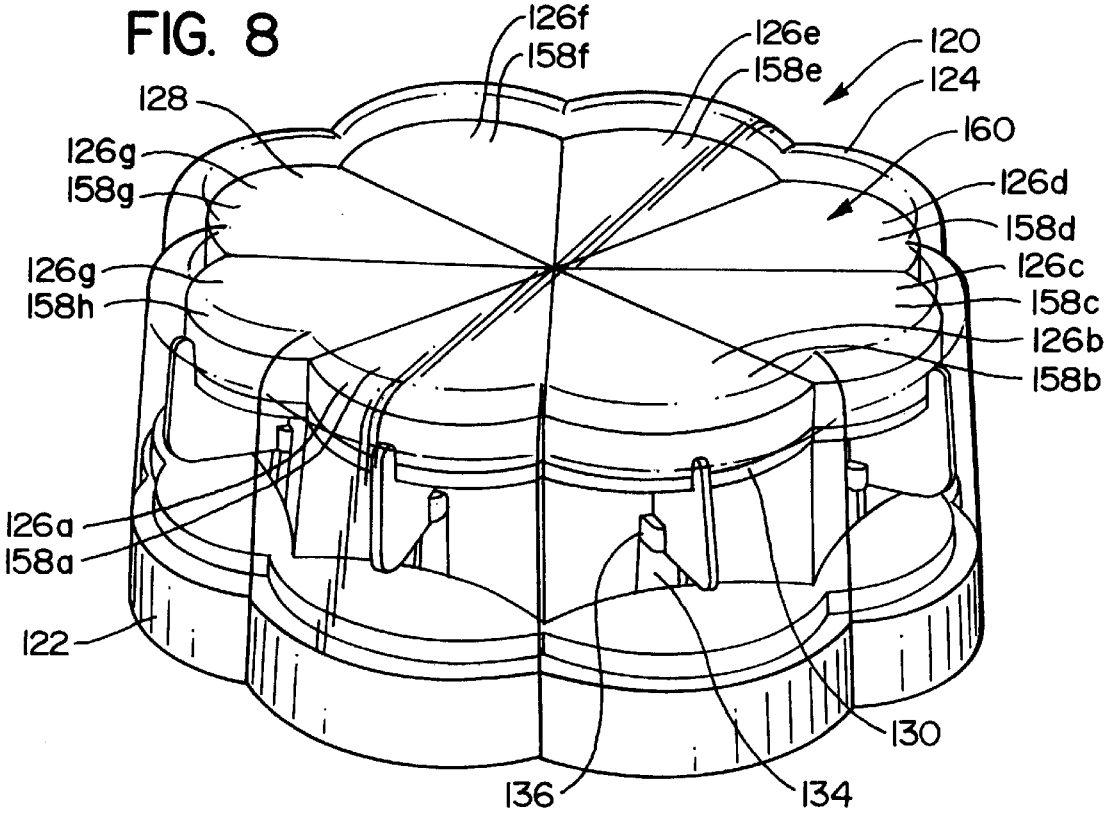
FIG. 8 is an isometric view of an ink pad assembly constructed in accordance with, and embodying, a second embodiment of the present invention.

Referring now to FIG. 8, depicted at 120 therein is a second exemplary ink pad assembly constructed in accordance with, and embodying, the principles of the present invention. As with the exemplary ink pad assembly 20 described above, the assembly 120 comprises: (a) a base 122; (b) a lid 124; and (c) a plurality of pad/plate assemblies 126*a–h*. Each pad/plate assembly 126 comprises an ink-impregnated absorbent pad 128 and mounting plate 130. As with the absorbent pads 28 described above, the absorbent pads 128 will normally, but not necessarily, be impregnated with different colors of ink.

The ink pad assembly 120 further comprises an attachment system 132 comprising: (a) a plurality of openings 134 formed in the base 122; and (b) a rail member 136 formed on each of the mounting plates 130 of the pad/plate assemblies 126*a–h*. The rail members 136 enter into and engage the openings 134 to mount the pad/plate assemblies 126*a–h* onto the base 122.

Figure 9:
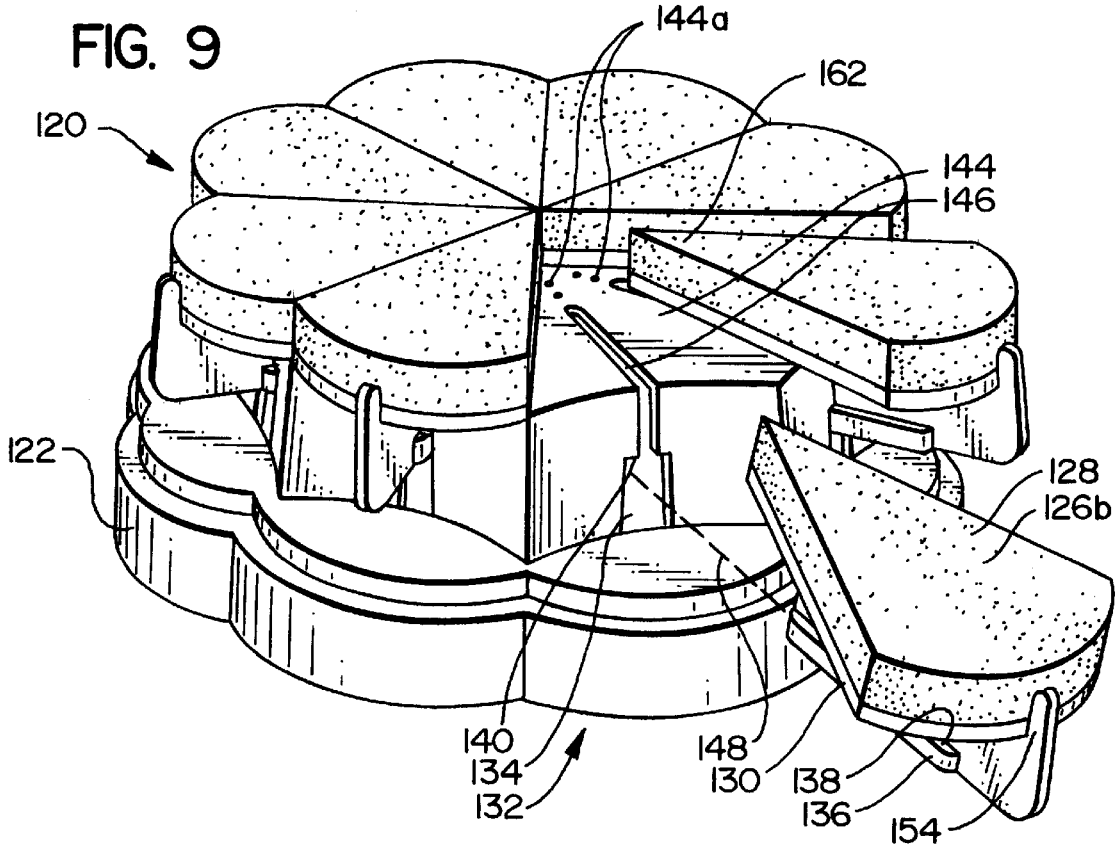
FIG. 9 is an isometric view of the ink pad assembly shown in FIG. 8 with the cover removed and depicting the removability of the pad/plate assemblies employed therein.
Figure 11:
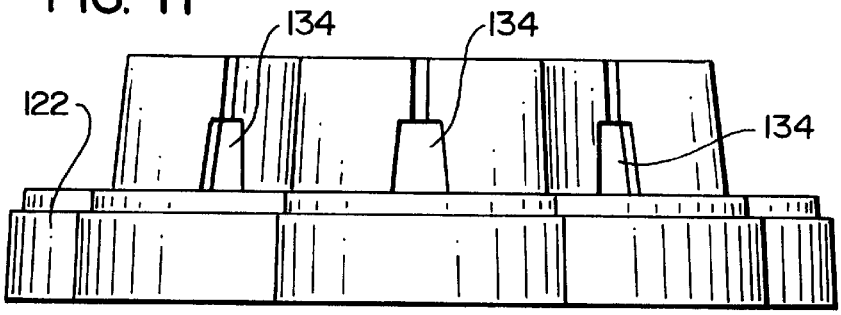
FIG. 11 is a side plan view of the base portion shown in FIG. 10.

In particular, shown in the drawing are upper surfaces 138 of the rail members 136 (FIG. 9), inner surfaces 140 on the base 122 that define the openings 134 (FIG. 9), lower surfaces 142 of the mounting member 130 (FIG. 11), and an upper surface 144 of the base 122 (FIGS. 9 and 11). Slots 146 are formed in the base upper surface 144, and opening axes as shown at 142 in FIG. 9 extend through the openings 134 parallel to the base upper surface 144.

When the pad/plate assembly 126 is displaced towards the base 122 such that the rail member 136 enters the slot 134 along the opening axis 148, the rail member upper surfaces 138 engage the base inner surfaces 140 to prevent upward movement of the pad/plate assembly 126 relative to the base 122; at the same time, the mounting member lower surfaces 142 engage the base upper surface 144 to prevent downward movement of the pad/plate assembly 126 relative to the base 122. Lateral movement is prevented by engagement of the rail member 136 with the base 122. The pad/plate assembly 126 is thus prevented from moving in directions other than along the opening axis 148.

Figure 12:
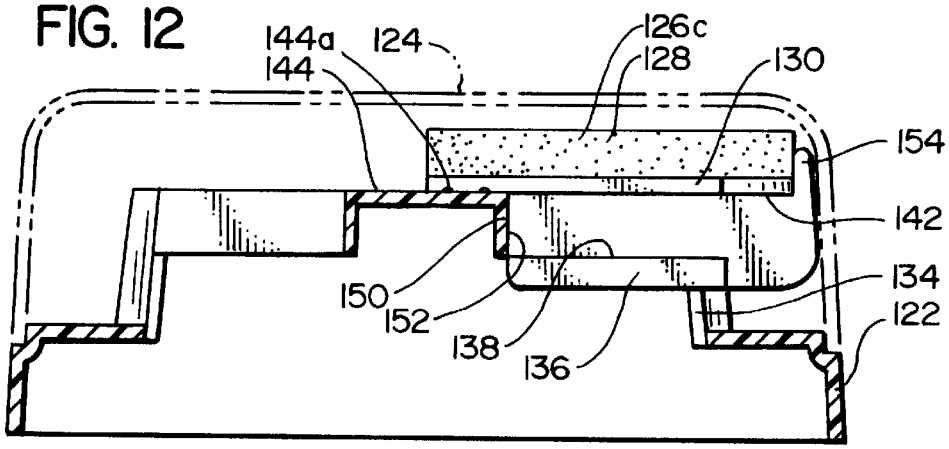
FIG. 12 is a side, cut-away view of the pad/plate assembly depicted in FIG. 8 having at least one pad/plate assembly attached thereto.

Additionally, FIG. 12 shows that, at a predetermined point, an end 150 of the rail member 136 engages a stop wall 152 on the base 122 at the end of the slot 146 to prevent further movement of the pad/plate assembly 126 towards the base 122.

Handles 154 are attached to outer ends of the rail members 136 to provide the user with additional surface area to grip when removing and reattaching the pad/plate assemblies 126.

The mounting member lower surfaces 138 are spaced from the rail member upper surfaces 142 such that frictional forces develop between the rail member upper surfaces 138 and the base inner surface 140 and between the mounting member lower surfaces 138 and the base upper surface 144. These frictional forces prevent inadvertent withdrawal of the pad/plate assemblies 126 from the base 122 but allow the end user manually to remove the pad/plate assemblies 126 form and reattach them to the base 122.

The frictional forces described above can be increased simply by forming one or more bumps 144*a* on the base upper surface 144 and/or mounting plate lower surface 142. Further, these bumps may be placed such that the friction increases just before the pad/plate assembly 126 is fully mounted on the base 122; with friction increasing means such as the bumps 144*a*, the pad/plate assembly 126 will slide easily until these bumps 144*a* are encountered, at which point the friction will increase.

Figure 10:
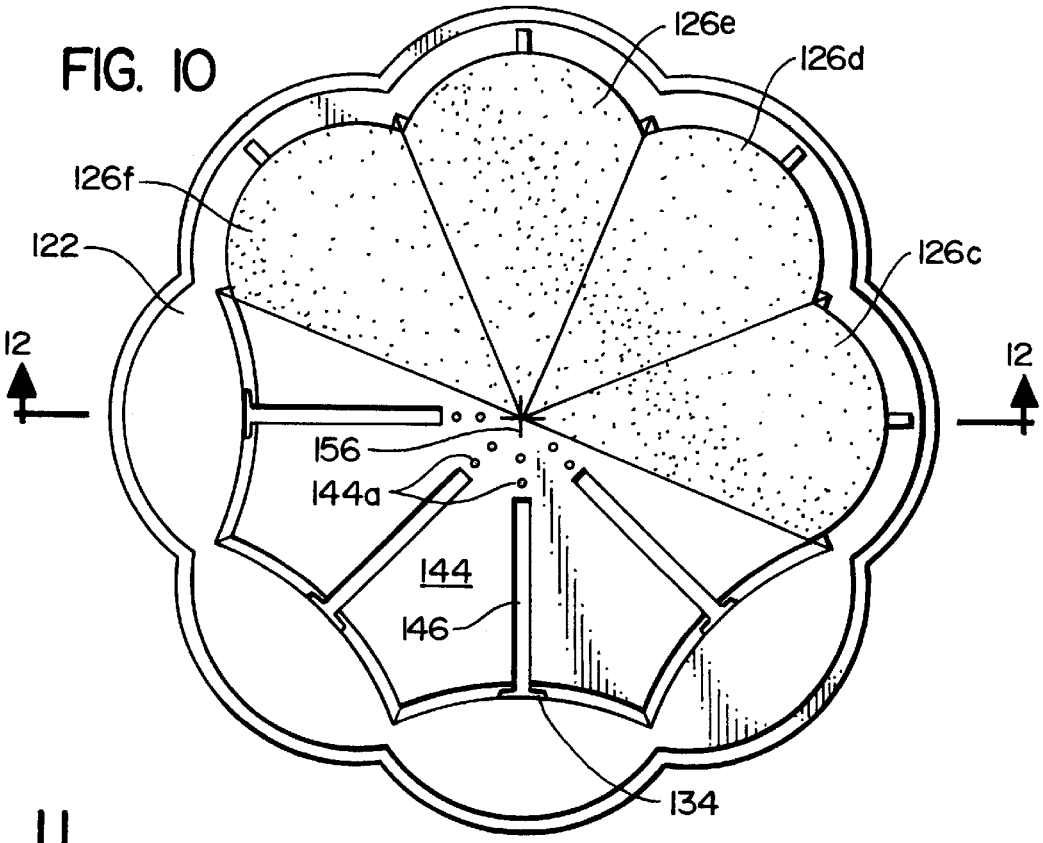
FIG. 10 is a top plan view of the base portion of the pad/plate assembly shown in FIG. 8 having four pad/plate assemblies attached thereto.

Referring for a moment to FIG. 10, it should also be noted that in the exemplary ink pad assembly 122 the slots 146 are arranged such that they extend radially outwardly from a vertical center axis 156 of the base 122. Further, the pad/plate assemblies present generally triangular or pie-shaped upper surfaces 158 that, when coupled with the radially extending slots 146, cause the inking surface 169 (FIG. 8) of the ink pad assembly 120 to be generally circular in overall shape.

As with the pad/plate assemblies 26 described above, the pad/plate assemblies 126 can be removed from the ink pad assembly 120 and used to apply ink directly to a rubber stamp. As will be discussed in detail below, the pointed ends 162 of the generally triangular assemblies 126 can be used like markers to apply ink very precisely onto the rubber stamp. The handles 154 facilitate the manipulation of the pad/plate assemblies 126 when they are used to apply ink to the rubber stamp.

III. HOLE/PEG ATTACHMENT SYSTEMS

Figure 13:
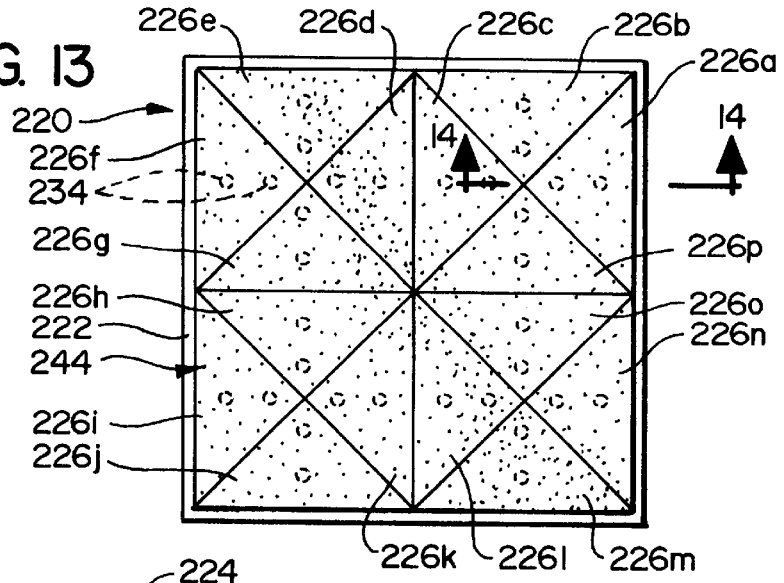
FIG. 13 depicts a pad/plate assembly constructed in accordance with, and embodying, the principles of a third embodiment of the present invention.
Figure 14:
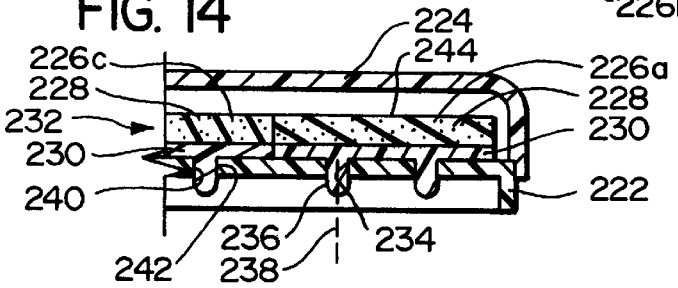
FIG. 14 is a partial, side, cut-away view depicting the mechanism by which pad/plate assemblies are mounted to the base portion of the ink pad assembly shown in FIG. 13.

Referring now to FIGS. 13 and 14, depicted at 220 therein is yet another exemplary ink pad assembly constructed in accordance with, and embodying, the principles of the present invention.

The third exemplary ink pad assembly 220 comprises: (a) a base 222; (b) a lid 224; and (c) a plurality of pad/plate assemblies 226*a–p*. As shown in FIG. 14, each pad/plate assembly 226 comprises an ink-impregnated absorbent pad 228 and a mounting plate 230. As with the absorbent pads 28 described above, the absorbent pads 228 will normally, but not necessarily, be impregnated with different colors of ink.

The ink pad assembly 220 further comprises an attachment system 232 comprising: (a) a plurality of openings 234 formed in the base 122; and (b) two pegs 236 formed on each of the mounting plates 230 of the pad/plate assemblies 226*a–p*.

To mount the pad/plate assembly 226 onto the base 222, the pad/plate assembly 226 is displaced towards the base 222 along a hole axis 238 until the pegs 236 enter into and engage the openings 234. In particular, as the pegs 236 enter the holes 234, inner surfaces 240 of the openings 234 engage outer surfaces 242 of the pegs 236 to prevent relative movement of the pad/plate assembly 222 in any direction relative to the base 222 except along the hole axis 238.

The pad/plate assembly 226 is further displaced towards the base 222 into an attached position shown in FIG. 14 in which a bottom surface 240 of the mounting member 224 contacts an upper surface 242 of the base 222.

The pegs 236 are oversized relative to the holes 234, resulting in frictional forces that inhibit the withdrawal of the pegs 236 from the holes 234. These frictional forces lock the pad/plate assembly 226 onto the base 222 to prevent inadvertent withdrawal of the pad/plate assembly 226, but are small enough to allow the end user manually to remove the pad/plate assembly 226 from the base 222 and to reattach the pad/plate assembly 226 onto the base 222.

A resulting inking surface 244 that is obtained by the exemplary ink pad assembly 220 employing pad/plate assemblies 226 in the form of right triangles is square, but the overall shape of the inking surface 244 can vary significantly depending upon the choice of the end user.

Further, the peg/hole attachment system 232 allows the use of pad/plate assemblies of a given specific shape as building blocks to construct the shapes and color compositions that ultimately form the inking surface 244. While the exemplary pad/plate assemblies 226 are in the form of right triangles, square, rectangular, equilateral or isosceles triangles, or other shapes may be used. The placement of holes 234 will be dictated by the size and shape of the pad/plate assemblies employed and the placement of pegs thereon.

The basic idea is to provide basic building blocks that allow the end user to create a wide variety of color configurations beyond the rectangular bands and pie-shaped configurations described above with reference to the ink pad assemblies 20 and 120. For example, a checkerboard pattern may be formed by making the pad/plate assemblies 226*a, b,c,p* in one quadrant and the assemblies 226*h,i,j,i* in the opposite quadrant a first color, while the assemblies 226*d, e,f,g* in one of the remaining quadrants and the assemblies 226*l,m,n,o* in the last quadrant are made a second color. Numerous other inking surface shapes are possible given different pad/plate assembly shapes. The attachment system 232 thus provides the end user enormous flexibility in the color selections and configurations available for use.

IV. TEMPORARY ADHESIVE ATTACHMENT SYSTEMS

Figure 15:
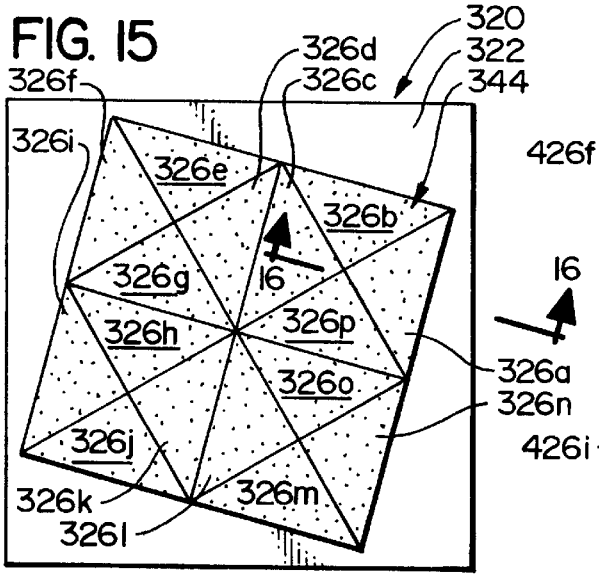
FIG. 15 depicts a pad/plate assembly constructed in accordance with, and embodying, the principles of a fourth embodiment of the present invention.
Figure 16:
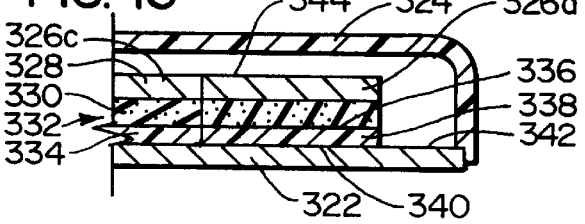
FIG. 16 is a partial, side, cut-away view depicting the mechanism by which pad/plate assemblies are mounted to the base portion of the ink pad assembly shown in FIG. 15.

Referring now to FIGS. 15 and 16, depicted at 320 therein is a fourth exemplary ink pad assembly constructed in accordance with, and embodying, the principles of the present invention.

This fourth exemplary ink pad assembly 320 comprises: (a) a base 322; (b) a lid 324; and (c) a plurality of pad/plate assemblies 326*a–p*. As shown in FIG. 16, each pad/plate assembly 326 comprises an ink-impregnated absorbent pad 328 and a mounting plate 330. As with the absorbent pads 28 described above, the absorbent pads 328 will normally, but not necessarily, be impregnated with different colors of ink.

The ink pad assembly 320 further comprises an attachment system 332 comprising an adhesive layer 334 attached onto each of the mounting plates 330 of the pad/plate assemblies 326*a–p*. In particular, an upper surface 336 of the adhesive layer 334 is permanently attached to a lower surface 338 of the mounting plate 330. A lower surface 340 of the adhesive layer 334 is tacky; the adhesive layer 334 thus temporarily attaches the mounting plate 330 to any portion of the lower surface 340 thereof that it comes in contact with.

Therefore, to mount the pad/plate assembly 326 onto the base 322, the pad/plate assembly 326 is displaced towards the base 322 until the adhesive layer lower surface 340 comes into contact with the upper surface 342 of the base 322. The bond created by the tacky lower surface 340 of the adhesive layer 334 is sufficient to prevent inadvertent removal of the pad/plate assembly 326 from the base 322, but is weak enough to allow the end user manually to remove the pad/plate assembly 326 form the base 322 and reattach the pad/plate assembly 3326 onto the base 322.

As with the ink pad assembly 220 described above, the pad/plate assemblies 326 are formed of right triangles and are assembled to form a square inking surface 344. However, these pad/plate assemblies 326 may also be provided in other shapes and assembled into inking surfaces having a number of overall shapes.

V. MAGNETIC ATTACHMENT SYSTEMS

Figure 17:
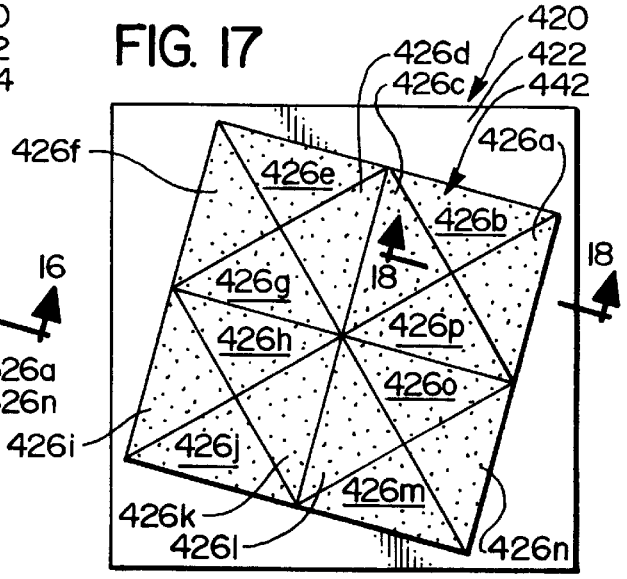
FIG. 17 depicts a pad/plate assembly constructed in accordance with, and embodying, the principles of a fifth embodiment of the present invention.
Figure 18:
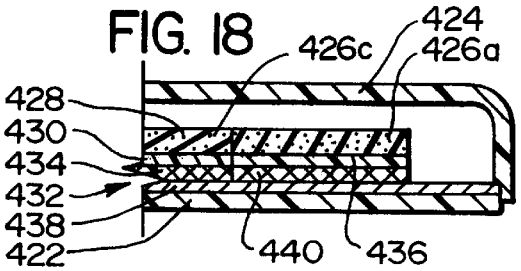
FIG. 18 is a partial, side, cut-away view depicting the mechanism by which pad/plate assemblies are mounted to the base portion of the ink pad assembly shown in FIG. 17.

Referring now to FIGS. 17 and 18, depicted at 420 therein is another exemplary ink pad assembly constructed in accordance with, and embodying, the principles of the present invention.

This additional exemplary ink pad assembly 420 comprises: (a) a base 422; (b) a lid 424; and (c) a plurality of pad/plate assemblies 426*a–p*. As shown in FIG. 16, each pad/plate assembly 326 comprises an ink-impregnated absorbent pad 428 and a mounting plate 430. As with the absorbent pads 28 described above, the absorbent pads 328 will normally, but not necessarily, be impregnated with different colors of ink.

The ink pad assembly 420 further comprises an attachment system 432 comprising: (a) a first layer 434 permanently attached to a lower surface 436 of each of the mounting plates 430 of the pad/plate assemblies 426*a–p*; and (b) a second layer 438 permanently attached to an upper layer 440 of the base 422. One of the first and second layers 434 and 436 is made of magnetic material, while the other of the first and second layers 434 and 436 is made of magnetically attractable material.

To mount the pad/plate assembly 426 onto the base 422, the pad/plate assembly 426 is displaced towards the base 422 until the first layer 434 is magnetically attracted to the second layer 438. This magnetic attraction fixes the pad/plate assembly 426 relative to the base 422, but can easily be overcome to allow the end user manually to remove the pad/plate assembly 426 from reattach the pad/plate assembly 426 to the base 422.

As with the ink pad assemblies 220 and 320 described above, the pad/plate assemblies 426 are right triangles and are assembled to form a square inking surface 442. However, as with the pad/plate assemblies 226 and 326 described above, the pad/plate assemblies 426 may also be provided in other shapes and assembled into inking surfaces having a number of overall shapes.

V. MODULAR SYSTEMS

As briefly described above, the pad/plate assemblies 26, 126, 226, 326, and 426 may be made in many different shapes that may be used as basic building blocks in a modular system that allows the construction of a variety of different inking surfaces. Further, this modularity can be carried across different base shapes such that the same basic pad/plate assembly building block may be used on rectangular bases such as the base 22 described above and the generally circular base 122 described above.

Figure 19:
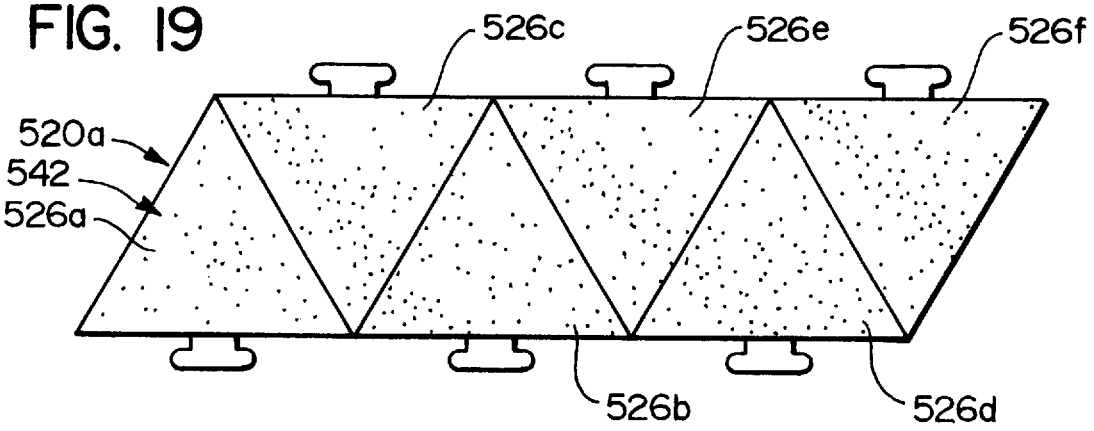
FIGS. 19 and 20 show two different configurations of pad/plate assemblies that may be formed using generally triangular-shaped pad/plate assemblies.
Figure 20:
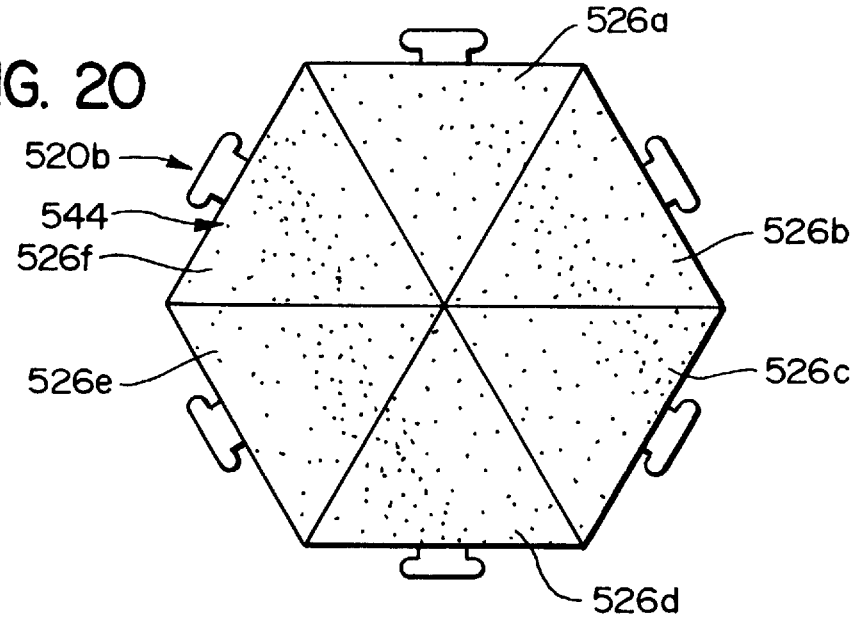

Referring now to FIGS. 19 and 20, shown at 520*a* and 520*b* therein are sixth and seventh exemplary ink pad assemblies constructed in accordance with, and embodying, the principles of the present invention. These ink pad assemblies 520*a* and 520*b* illustrate a modular system in which a single pad/plate assembly configuration is used with two different base configurations.

As shown in the drawings, the same group of triangular pad/plate assemblies 526*a–f* is used in each of the ink pad assemblies 520*a* and 520*b*. The ink pad assemblies 520*a* and 520*b* employ a rail/friction attachment system 532 that is the same as the attachment system 132 described above. Further, except for shape, the pad/plate assemblies 526 are exactly the same as the pad/plate assemblies 126 described above. The details of the attachment system 532 and pad/plate assemblies 526 will thus not be described again in detail herein.

Figure 21:
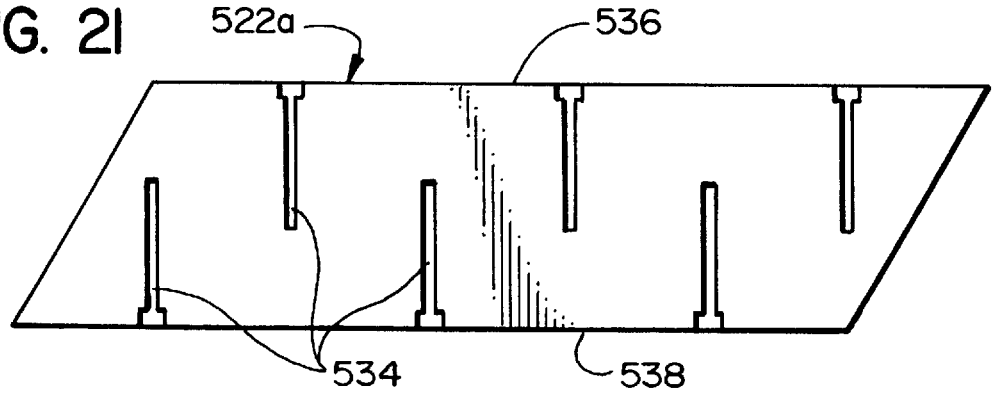
FIG. 21 shows a base portion that may be employed to obtain the arrangement of pad/plate assemblies shown in FIG. 19.
Figure 22:
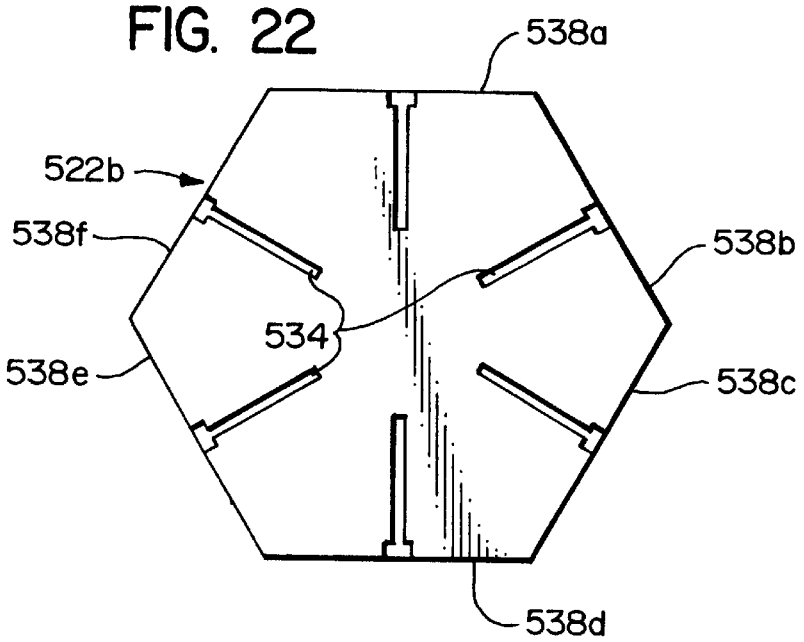
FIG. 22 shows a base portion that may be employed to obtain the pad/plate assembly configuration shown in FIG. 20.

A first base shown at 522*a* in FIG. 21 forms a part of the sixth ink pad assembly 520*a*, and a second base shown at 522*b* in FIG. 22 forms a part of the seventh ink pad assembly 520*b*. On the first base 522*a*, slots 534 forming a part of the attachment system 526 are parallel to each other and extend inwardly from opposing edges 536 and 538 of the base 522*a*. On the second base 522*b*, the slots 534 forming a part of the attachment system 526 extend radially inwardly from peripheral edges 538*a–f* of the base 522*b*.

The result is that an inking surface 542 formed by the pad/plate assemblies 526*a–f* mounted on the first base 522*a* is a parallelogram, while an inking surface 544 formed by the same pad/plate assemblies 526*a–f* mounted on the second base 522*b* is a hexagon. The triangular pad/plate assemblies 526 may thus be used as basic building blocks with different bases to obtain a wide number of different inking surfaces with an even greater number of color configurations and compositions.

Further, while the exemplary ink pad assemblies 520*a* and 520*b* employed a rail/friction attachment system, any of the other types of attachment system would operate in a similar manner. In general, the pressure fit, rail, and hole/peg attachment systems are desirable when positive registration of pad/plate assemblies is required, and the temporary adhesive and magnetic attachment systems are effective when a more free-form approach to combining pad/plate assemblies is desired.

It should also be noted that the various attachment schemes described above may be combined in any given ink pad assembly. For example, temporary adhesive may be used to attach one or more absorbent pads to a mounting plate like the mounting plate 30*i* of the pad/plate assembly 26*i* described above. The mounting plate may then be attached to the base using a tab attachment system to form a completed ink pad assembly. Numerous other variations may be possible to provide the end user with even greater flexibility.

VII. METHODS OF USE

Referring now to FIGS. 23–27, the method of using an ink pad assembly according to the principles of the present invention will not be described.

Figure 23:
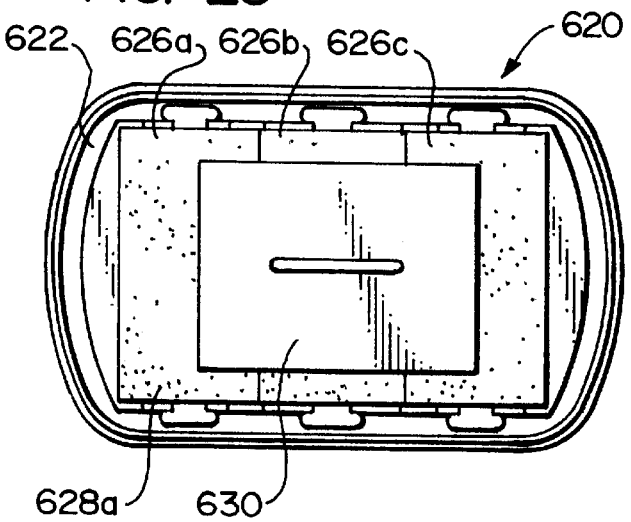
FIGS. 23–27 show methods of using an ink pad assembly as depicted in FIG. 1.

In particular, FIG. 23 depicts a top view of an ink pad assembly 620 similar to the assembly 20 described above. This ink pad assembly 620 comprises a base 622 and pad/plate assemblies 626*a–c*.

Figure 24:
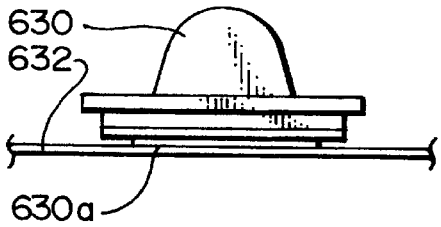

Initially, as shown in FIG. 23, the pad/plate assemblies 626*a*, 626*b*, and 626*c* are mounted in that order on the base 622 to define an inking surface 628*a*. A printing surface of a rubber stamp or printing die 630 is brought into contact with the inking surface 628*a* to transfer ink from the pad/plate assemblies 626*a–c* to a printing surface 630*a* of the die 630. Referring to FIG. 24, the printing surface 630*a* of the printing die 630 is then brought into contact with an image carrying member 632 to form an ink image thereon.

Figure 25:
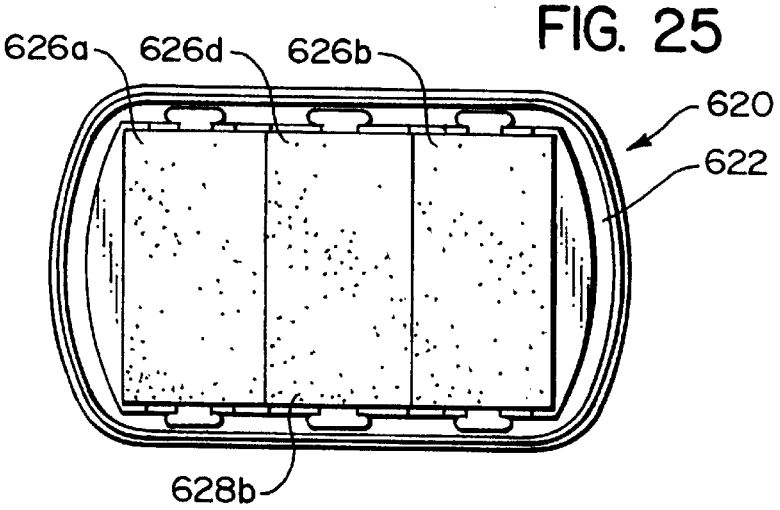
Figure 26:
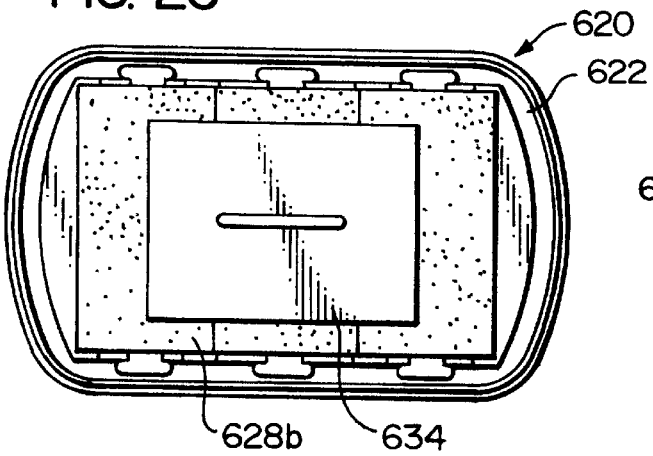
Figure 27:
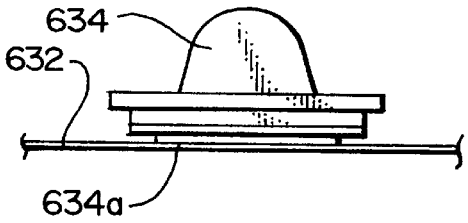

Next, as shown in FIG. 25, the pad/plate assemblies 626*a* and 626*b* and a new pad/plate assembly 626*d* are attached on the base 622 as generally described above to create an inking surface 628*b* with a different arrangement and composition of colors. As shown in FIG. 26, another printing die 634 is then brought into contact with the newly formed inking surface 628*b* to transfer ink from this surface 628*b* to a printing surface 634*a* of the printing die 634. FIG. 27 shows that this printing die 634 is then brought into contact with the image carrying member 632 to form a second image thereon. The two images formed as just-described are composed of color configurations created by the end user.

Figure 28:
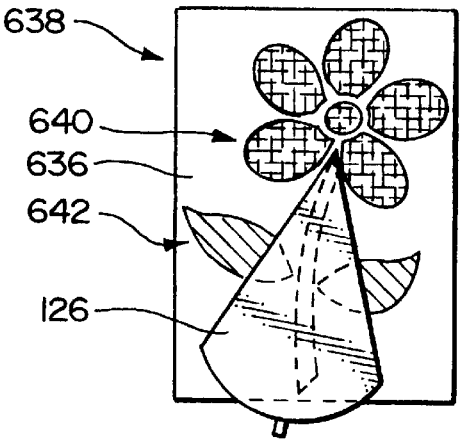
FIG. 28 depicts a method of using the pad/plate assemblies of the ink pad assembly shown in FIG. 8.

Additionally, as shown in FIG. 28, pad/plate assemblies may be removed from the base and brought into direct contact with a printing surface of a stationary printing die. In FIG. 28, a pad/plate assembly 126 as described above is shown being used to apply ink to a rubber stamp 636 having a flower image 638 formed thereon. The flower image 636 basically comprises a petal portion 640 and a stem/leaf portion 642. The pointed end of the assembly 126 allows ink to be applied to the stem/leaf portion 642 and not to the petal portion 640; a pad/plate assembly 126 of a different color may be subsequently used to apply ink to the petal portion 640. Accordingly, the pad/plate assembly 126 may be used individually and not as part of a group of such assemblies mounted on a base.

While the pad/plate assemblies 126 having pointed ends are perhaps the most effective for use individually as just-described, the other pad/plate assemblies described herein may also be used individually with similar effect.

The end result is that the present invention provides the end user with enormous flexibility in forming either single color or multi-color ink images. This flexibility is highly advantageous in the art stamping field. Such flexibility of use has heretofore been completely unavailable to art stampers.

VIII. METHODS OF MANUFACTURE

Not only does the present invention present advantages to the end user, manufacturers will benefit from the principles of the present invention. The pad/plate assemblies may be manufactured, stored, and sold separate from the bases. However, when preconfigured ink pad assemblies are desired, the pad/plate assemblies may be assembled onto bases to obtain the required number of each configuration of ink pad assemblies required to satisfy the order, and no more. The manufacture thus need not manufacture more preconfigured ink pad assemblies than are ordered.

Figure 29:
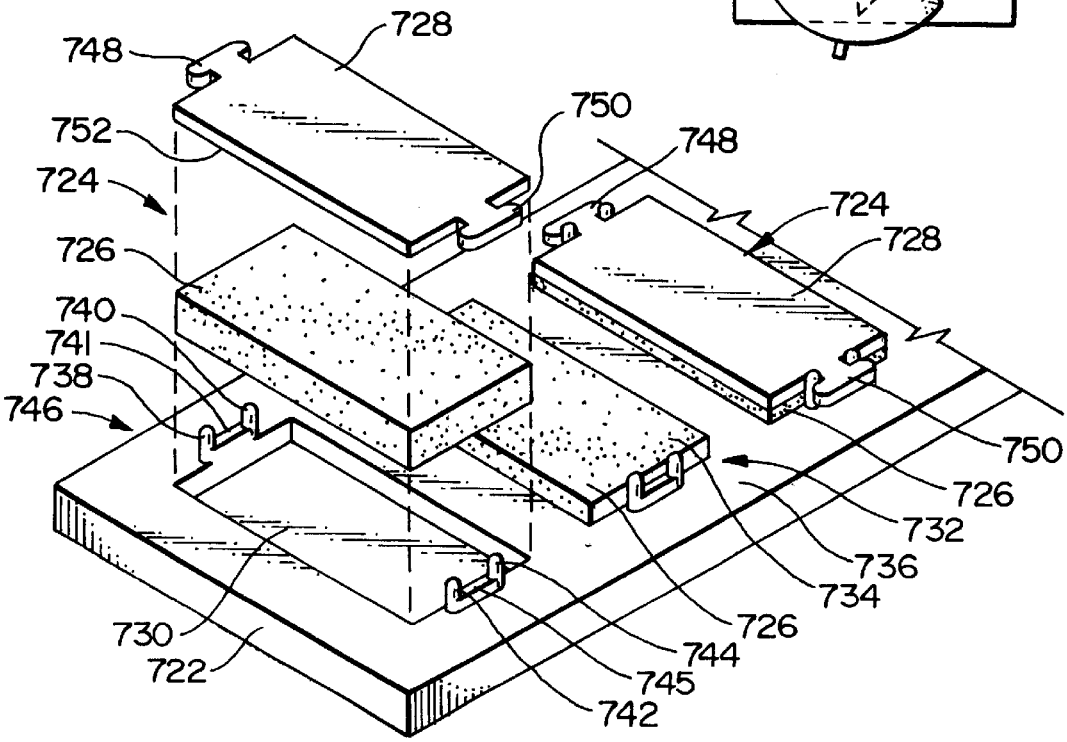
FIG. 29 depicts an assembly for allowing the manufacture and sale of pad/plate assemblies forming a part of the ink pad assembly shown in FIG. 1.
Figure 30:
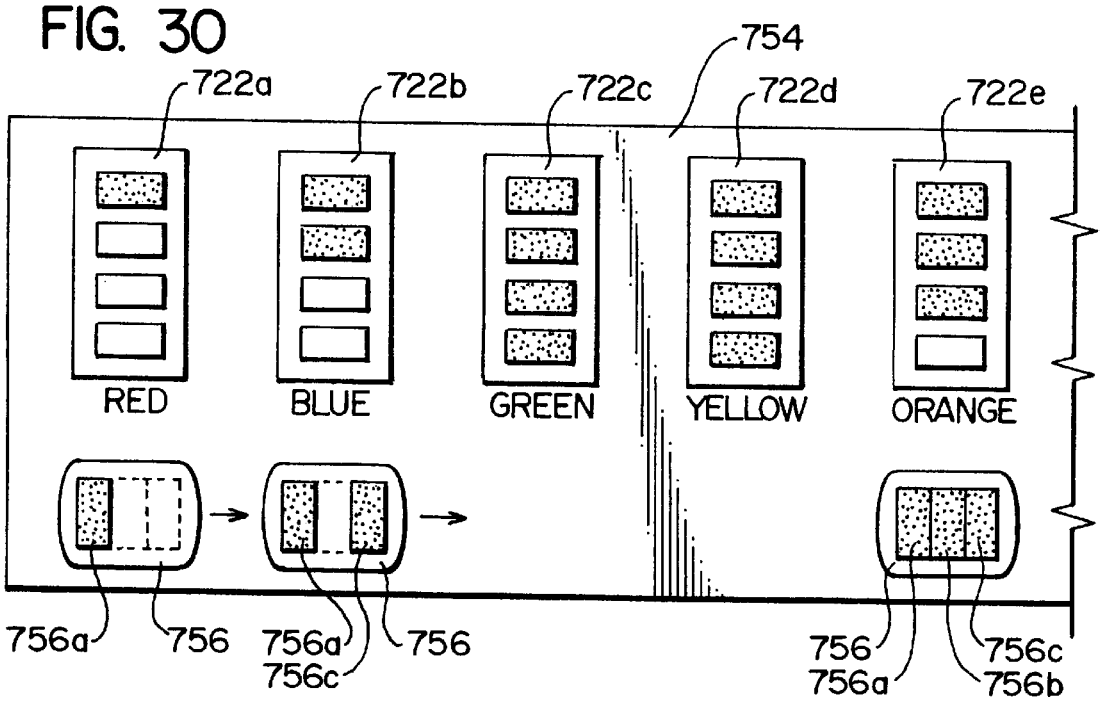
FIG. 30 depicts a method of assembling ink pad assemblies such as the ink pad assembly shown in FIG. 1.

Referring for a moment to FIGS. 29 and 30, the method of manufacturing ink pad assemblies according to the principles of the present invention will be explained in further detail.

The method of manufacture of the present invention comprises two basic steps- first, assembly of the pad/plate assemblies; and, second, assembly of the ink pad assemblies. The first of these steps is basically shown in FIG. 29.

In FIG. 29 is depicted a holding tray assembly 720. This holding tray assembly 720 comprises a holding tray 722 and a plurality of pad/plate assemblies 724 comprising absorbent pads 726 and mounting plates 728. The pad/plate assemblies 724 manufactured as shown in FIG. 29 are identical to the pad/plate assemblies 126 described above. However, other configurations of pad/plate assemblies may be manufactured using the basic manufacturing techniques shown in FIGS. 29 and 30.

The holding tray 720 defines a series of cavities 730. The plan view of the cavities 730 is approximately the same as that of the absorbent pads 724; however, the volume of these cavities 730 is approximately half that of the absorbent pads 724. Accordingly, as shown at 732 in FIG. 29, an upper surface 734 of these pads 724 extends above an upper surface 736 of the assembly tray 720 when a given absorbent pad 724 is within its corresponding cavity 730.

A registration system 746 for attaching the mounting plates 728 onto the tray 720 above the cavities 730 is formed by: (a) posts 738 and 740 connected by a short rib 741 and posts 742 and 744 connected by a short rib 745, the posts 738, 740, 742, and 744 and ribs 741 and 745 being formed on the holding tray 720 adjacent to each of the cavities 730; and (b) tabs 748 and 750 formed on the mounting plates 728. The posts 738–744 form a pressure fit with the tabs 748 and 750 to attach the mounting plates 728 onto the tray 722. The pressure fit formed between the posts 738–744 and the tabs 748 and 750 is similar to that formed between the tab 58*b* and projections 34 and 36 shown in FIG. 32.

To manufacture a plurality of pad/plate assemblies 724, an absorbent pad 726 is placed in each of the plurality of cavities 730 formed in the tray 720 as shown at 732. An adhesive is then placed on a bottom face 752 of a given one of the mounting plates 728. The given mounting plate 728 is then displaced towards the tray 722 until the posts 738–744 engage the tabs 748 and 750 to attach the given mounting plate 728 onto the tray 722 above a given one of the cavities 730; as the absorbent pads 726 have been placed in the cavities 730, the adhesive on the plate bottom face 752 comes in contact with the upper surface 734 of the absorbent pad 726 in the given cavity 730.

The fact that the absorbent pads 726 extend slightly above the upper surface 736 of the tray 722 lessens the likelihood that uncured adhesive will contact the tray 722. Further, the mounting plates 728 will compress the pads 726 slightly to ensure good contact between the adhesive on the mounting plates 728 and the absorbent pads 726.

This process is repeated until all of the cavities 730 are covered by mounting plates 728. The registration system 746 holds the mounting plates 728 in place on the tray 722 until the adhesive cures. The pad/plate assemblies 724 so formed may be stored on the tray 722 or removed immediately after the adhesive cures.

Importantly, the registration system 746 precisely registers the mounting plates 728 above the cavities 730 such that the absorbent pads 726 are correctly attached to the mounting plates 728; any misalignment of the pads 726 on the plates 728 may result in gaps between adjacent pads forming a multi-color ink pad assembly or even an inability to mount two misaligned pad/plate assemblies next to each other onto the appropriate base.

The short ribs 741 and 745 that extend between the posts 738, 740 and 742, 744 ensure that the mounting plates 728 are spaced lightly above the upper surface 736 of the tray 722. This helps to prevent uncured adhesive from coming into contact with the tray upper surface 736 during assembly of the pad/plate assemblies 724 and provides the assembler or end user an easier grip when removing these assemblies 724 from the tray.

It should be noted that the registration system 746 can be altered to allow the manufacture of other configurations of pad/plate assemblies. For example, with a rail/slot attachment system 132 as shown in FIGS. 8–12, the tray 722 may be provided with a lid. The mounting plates are engaged with slots formed in the lid, and the lid mounted to the tray 722 such that the mounting plates are accurately located above the recesses in the tray 722. When the adhesive cures, the lid may be removed from the tray and used to store the pad/plate assemblies formed thereby. A similar lid registration system would work well with a peg/hole attachment system.

The second basic step in the process of manufacturing multi-color ink pad assemblies is to attach the pad/plate assemblies formed as described above in an appropriate configuration onto a base. An exemplary work table for performing this step is shown at 754 in FIG. 30. First through fifth trays 722*a*, 722*b*, 722*c*, 722*d*, and 722*e* as described above are shown arranged in that order on the table 754. The exemplary first through fifth trays 722*a–e* are associated with the colors red, blue, green, yellow, and orange, respectively. Each of these trays 722*a–e* contains one or more pad/plate assemblies 724 formed as described above. The absorbent pads 726 of the pad/plate assemblies 724 are impregnated with colored inks. The color of the ink contained by any given one of the absorbent pads 726 is the same as that associated with the tray 722 in which the given pad 726 is stored.

In general, based on a desired color configuration, pad/plate assemblies 724 of desired color configurations are selected from the trays 722*a–e* and mounted in a desired order on a base. In particular, if the desired configuration of colors is RED-ORANGE-BLUE in that order, a base shown at 756 is moved from left to right across the table 754: to a position adjacent to the red tray 722*a*, to a position adjacent to the blue tray 722*b*, and to a position adjacent to the orange tray 722*e*. At the red tray 722*a*, a pad/plate assembly 724 is removed and attached to a first position 756*a* of the base 756. At the blue tray 722*b*, a pad/plate assembly 724 is removed and attached to a third position 756*c* of the base 756. At the orange tray 722*e*, a pad/plate assembly 724 is removed and attached to a second position 756*b* of the base 756. A completed ink pad assembly 758 is thus formed by the base 756 having the desired colors of pad/plate assemblies 724 attached thereto in the desired order: RED-ORANGE-BLUE.

The manufacturing methods of the present invention described above can easily be expanded to more than five colors and to ink pad assemblies having more or fewer than three colors. These methods make efficient use of production facilities and decrease the number of fully assembled ink pad assemblies that must be kept in the manufacturer's inventory.

One other significant feature of the trays 722 as described above is that these trays may be sold to the end user either filled with different colors of pad/plate assemblies or empty to allow the end user to collect pad/plate assemblies sold individually. The end user may use the trays 722 to store pad/plate assemblies and as a palette from which colors are selected and mounted on a base in a desired configuration.

IX. RAIL/DETENT ATTACHMENT SYSTEM

Figure 31:
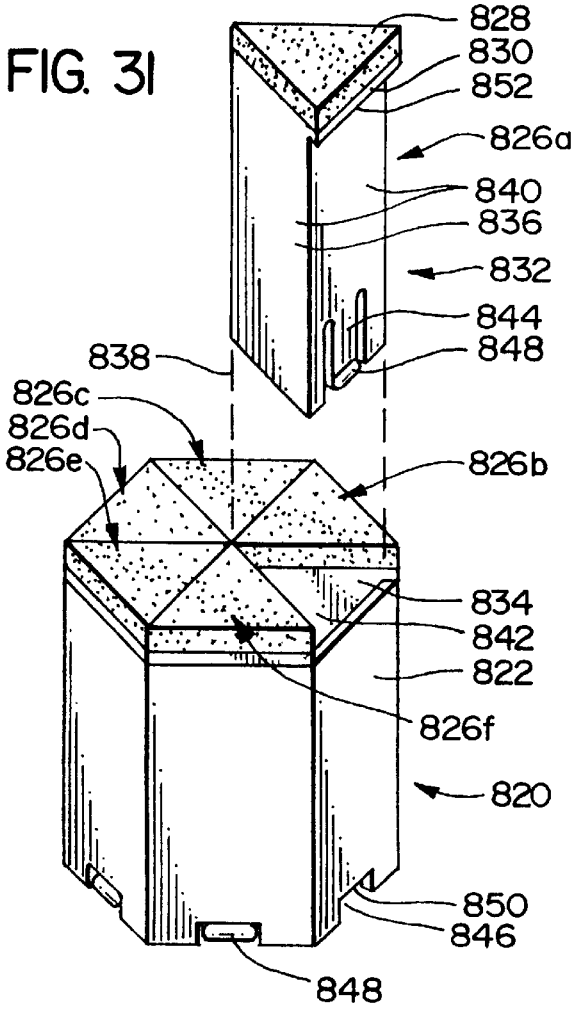
FIG. 31 depicts an ink pad assembly constructed in accordance with, and embodying, yet another embodiment of the present invention.

Referring now to FIG. 31, depicted at 820 therein is another exemplary ink pad assembly constructed in accordance with, and embodying, the principles of the present invention. As with the exemplary ink pad assemblies described above, the assembly 820 comprises: (a) a base 822; and (b) a plurality of pad/plate assemblies 826*a–f*. Each pad/plate assembly 826 comprises an ink-impregnated absorbent pad 828 and a mounting plate 830. As with the absorbent pads described above, the absorbent pads 828 will normally, but not necessarily, be impregnated with different colors of ink.

The ink pad assembly 820 further comprises an attachment system 832 comprising: (a) an opening 834 formed in the base 822; and (b) a rail member 836 formed on each of the mounting plates 830 of the pad/plate assemblies 826*a–h*. The rail members 136 enter into and engage the openings 134 to mount the pad/plate assemblies 126*a–h* onto the base 122.

When the pad/plate assembly 826 is displaced downwardly relative to the base 822 such that the rail member 836 enters the opening 134 along an opening axis 838, rail member surfaces 840 engage base inner surfaces 842 and adjacent rail member surfaces 840 to prevent lateral movement of the pad/plate assembly 826 relative to the base 822. Friction between the surfaces 840 and 842 will inhibit movement withdrawal of the pad/plate assemblies 826 from the base 822 but allow the assemblies 826 to be manually removed from the base 822 when required.

Additionally, a detent locking system may be formed for each of the pad/plate assemblies 826 to positively lock these assemblies 826 onto the base. In particular, a detent 844 is formed in each of the assemblies 826, and notches 846 corresponding to each of the detents 844 are formed in the base 822. Each of the detents has a rounded projection 848 formed thereon such that, when the rail members 836 are fully inserted into the opening 834, the rounded projections 848 engage a base surface 850 surrounding the notch 846 to prevent withdrawal of the pad/plate assemblies 826 upward along the opening axis 838.

To withdraw the pad/plate assemblies 826 from the base 822, the user need only apply a slight inward pressure to the projections 848 to cause them to release from the surfaces 850. Rounding the projections 848 facilitates this release. Then, by pushing up through the bottom of the base 822 or gripping a projection on the pad/plate assembly 826 such as an overhang 852, the pad/plate assembly 826 may be withdrawn from the base 822.

As with the other exemplary ink pad assemblies described above, the assembly 820 allows the pad/plate assemblies 826 to be randomly rearranged to obtain various color configurations.

X. MODIFIED PRESSURE FIT ATTACHMENT SYSTEM

Figure 34:
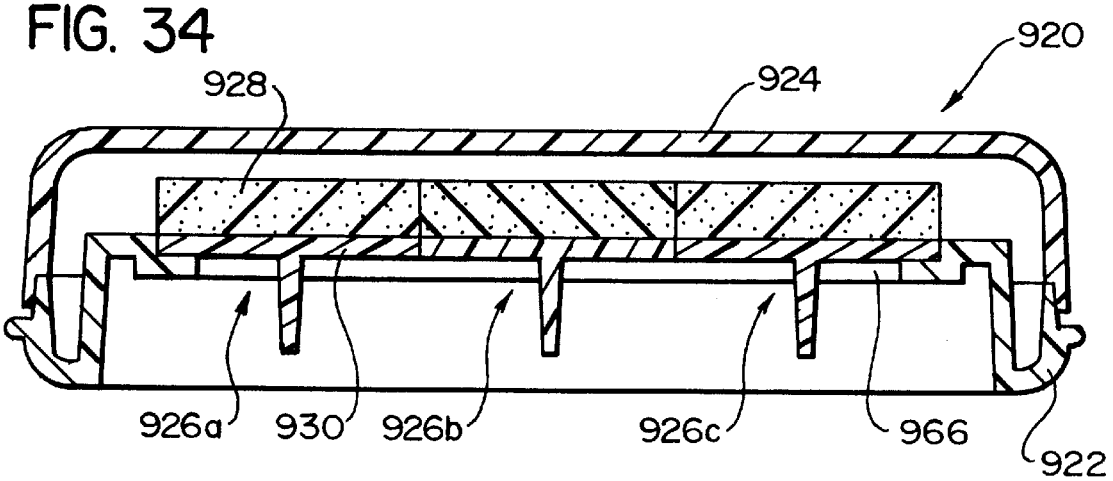
FIG. 34 is a section view taken along lines 34—34 in FIG. 33 showing how the pad/plate assemblies are supported by the base member.
Figure 35:
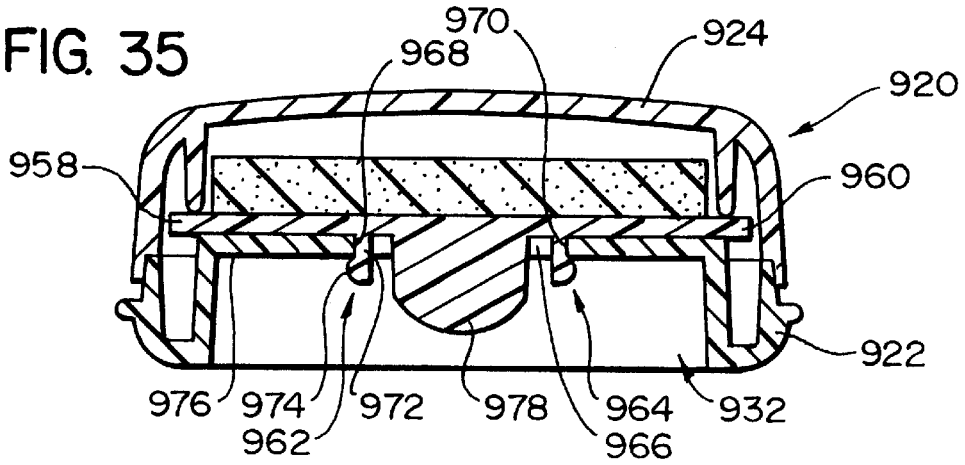
FIG. 35 is a section view taken along lines 35—35 in FIG. 33 showing how the pad/plate assemblies are attached to the base member.

Turning again to the drawing, another exemplary ink pad assembly constructed in accordance with the principles of the present invention is shown at 920 in FIGS. 34 and 35. This ink pad assembly 920 basically comprises: (a) a base 922; (b) a lid 924; and (c) first, second, and third pad/plate assemblies 926*a–c*. Each pad/plate assembly 926 comprises an ink-impregnated absorbent pad 928 and a mounting plate 930. Normally, but not necessarily, the absorbent pads 928*a–c* will be impregnated with different colors or ink.

The assembly 920 differs from the assembly 20 described above primarily in the construction and operation of an attachment system 932 that allows the pad/plate assemblies 926 to be detachably attached to the base 922.

Figure 33:
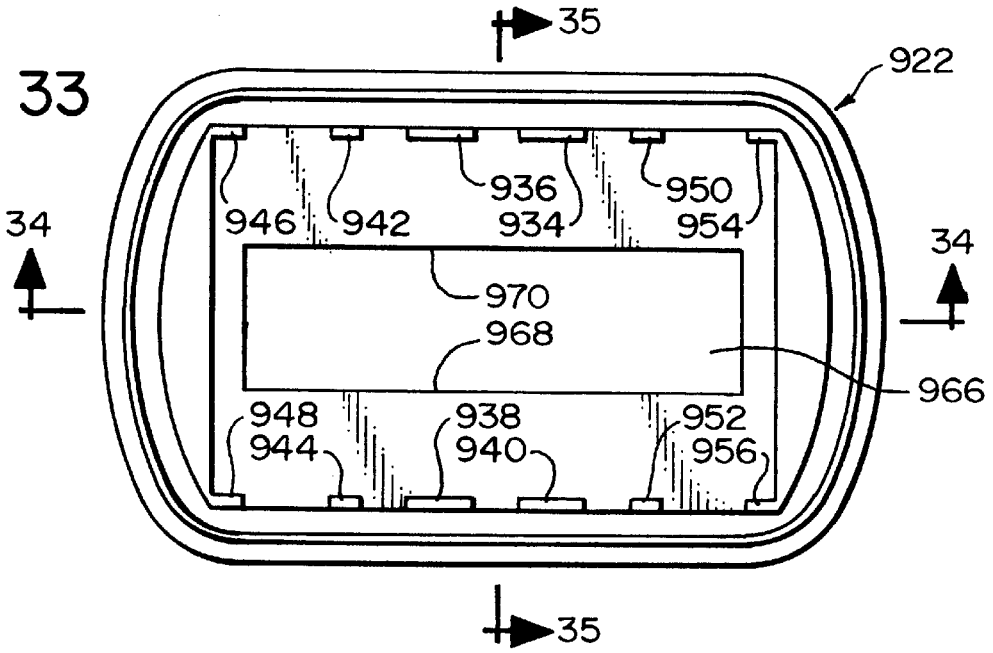
FIG. 33 is a top plan view of a base member of yet another ink pad assembly embodying the principles of the present invention.

The attachment system 932 comprises: (a) first through twelfth mounting projections 934–56 (FIG. 33) formed as part of the base 922; (b) a pair of locking tabs 958 and 960 (FIG. 35) formed as part of each of the mounting plates 930; (c) a pair of detent members 962 and 964 (FIG. 35) formed as part of each of the mounting plates 930; and (d) a hole 966 (FIGS. 33–35) formed in the base 922. The attachment system 932 differs from the system 32 described above primarily in the use of the detent members 962 and 964 and the hole 966.

As described above, the mounting projections engage the locking tabs to form a pressure fit that helps to hold the pad/plate assemblies 926 onto the base 922. Additionally, the detent members 962 and 964 extend through the hole 966 and engage edges 968 and 970 of the base member 922 defining the hole 966 to lock the pad/plate assemblies onto the base 922 against inadvertent removal.

The detent members 962 and 964 are identical, being simply reversed from each other, so only the detent member 962 will be described in detail. The detent member 962 comprises a shaft portion 972 and a projection 974 extending therefrom. The shaft portion is of sufficient length that, when the pad/plate assembly 926*b* is firmly seated onto the base 922, the projection 974 is immediately adjacent to a bottom surface 976 of the base member 922.

In particular, the pad/plate assembly 926*b* is displaced relative to the base 922 such that the projection 974 of the detent member 962 engages the edge 968. Application of slight manual pressure at that point causes the detent member 962 to deflect slightly inwardly to allow the projection to pass the edge 968.

When the pad/plate assembly 926*b* is firmly seated on the base 922, the projection 974 just clears the edge 968, which allows the detent member 962 to spring back into its original position. At this point, the projection 974 engages the bottom surface 976 to latch the pad/plate assembly 926*b* onto the base 922 against inadvertent removal. But the deliberate application of manual force on the pad/plate assembly 926*b* can overcome this latching action by deflecting the detent member 962 inwardly to allow the projection 974 to again clear the edge 968 on the way back through the hole 966. The projection 974 is rounded to help it ride up and over the edge 968 as the pad/plate assembly 926*b* is being attached to and detached from the base 922.

The attachment system 932 thus attaches the pad/plate assemblies 926 onto the base 922 in a slightly more secure fashion than that of the attachment system 932 described above.

The hole 966 in the base 922 used by the attachment system 932 further allows each of the plate members 930 to be provided with a fin projection 978. The fin projection 978 is arranged between the detent members 962 and 964 and extends through the hole 966 when the pad/plate assembly is attached to the base. The fin projection 978 makes the pad/plate assembly 926 slightly easier to handle than the pad/plate assembly 26 described above.

From the foregoing, it should be apparent that the present invention can be embodied in forms other than those described above. The above-described embodiments are therefore to be considered in all respects illustrative and not restrictive, the scope of the invention being indicated by the appended claims rather than the foregoing description. All changes that come within the meaning and scope of the claims are intended to be embraced therein.

I claim:

1. An ink pad assembly comprising:

a base having a hole formed therein; and a plurality of pad/plate assemblies each comprising a mounting member having a pair of detent members formed thereon, a fin member, and an absorbent pad attached to the mounting member, where each absorbent pad is impregnated with ink; wherein the detent members pass through the hole in the base and engage a bottom surface of the base to lock the mounting member onto the base against inadvertent removal; and each fin member is arranged to extend through the hole in the base when the pad/plate assembly associated therewith is attached to the base.

2. An ink pad assembly as recited in claim 1, in which the detent member comprises a shaft portion and a projection extending from the shaft portion.

3. An ink pad assembly as recited in claim 2, in which the projection is rounded.

4. An ink pad assembly as recited in claim 1, in which:

a single hole is formed in the base; and the fin projections associated with the attached pad/plate assemblies each extend through the single hole in the base.

5. An ink pad assembly as recited in claim 4, in which the detent projections associated with the attached pad/plate assemblies each extend through the single hole in the base and engage a portion of the base defining the single hole.

6. An ink pad assembly as recited in claim 1, in which:

a single hole is form ed in the base; and the detent projections associated with the attached pad/plate assemblies each extend through the single hole in the bas e and engage a portion of the base defining the single hole.

7. An ink pad assembly comprising:

a base having at least one hole formed therein; and a plurality of pad/plate assemblies each comprising a mounting member having at least one detent projection and a fin projection formed thereon, and an absorbent pad attached to the mounting member, where each absorbent pad is impregnated with ink; wherein the detent projection p asses through the hole in the base and engages a bottom surface of the base to lock the mounting member onto the base against inadvertent removal; and each fin projection is arranged to extend through the hole in the base when the pad/plate assembly associated therewith is attached to the base.

8. An ink pad assembly as recited in claim 7, in which the detent projection comprises a shaft portion and a locking projection extending from the shaft portion.

9. An ink pad assembly as recited in claim 8, in which the locking projection is rounded.

10. An ink pad assembly as recited in claim 7, in which:

a single hole is formed in the base; and the fin projections associated with the attached pad/plate assemblies each extend through the single hole in the base.

11. An ink pad assembly as recited in claim 10, in which the detent projections associated with the attached pad/plate assemblies each extend through the single hole in the base and engage a portion of the base defining the single hole.

12. An ink pad assembly as recited in claim 7, in which:

a single hole is formed in the base; and the detent projections associated with the attached pad/plate assemblies each extend through the single hole in the base and engage a portion of the base defining the single hole.

13. An ink pad assembly comprising:

a base;

a plurality of pad/plate assemblies each comprising a mounting member, and an absorbent pad attached to the mounting member, where each absorbent pad is impregnated with ink; and an attachment system comprising a pair of tab members and at least one resilient detent member formed on each of the mounting members, a plurality of mounting projections formed on the base member, and at least one hole formed in the base member; wherein the tab members engage the mounting projections to align the pad/plate assemblies on the base and to form at least part of a friction fit that attaches the pad/plate assemblies to the base, and the detent members deflect and pass through the at least one hole in the base member to positively lock the pad/plate assemblies onto the base but can be deflected to allow manual removal of the pad/plate assemblies from the base.

14. An ink pad assembly as recited in claim 13, in which each mounting member further comprises a fin projection arranged to extend through the hole in the base when the pad/plate assembly associated therewith is attached to the base.

15. An ink pad assembly as recited in claim 14, in which the detent projection comprises a shaft portion and a locking projection extending from the shaft portion.

16. An ink pad assembly as recited in claim 15, in which the locking projection is rounded.

17. An ink pad assembly as recited in claim 14, in which:

a single hole is formed in the base; and the fin projections associated with the attached pad/plate assemblies each extend through the single hole in the base.

18. An ink pad assembly as recited in claim 13, in which:

a single hole is formed in the base; and the detent projections associated with the attached pad/plate assemblies each extend through the single hole in the base and engage a portion of the base defining the single hole.

19. An ink pad assembly as recited in claim 14, in which a single hole is formed in the base;

the fin projections associated with the attached pad/plate assemblies each extend through the single hole in the base; and the detent projections associated with the attached pad/plate assemblies each extend through the single hole in the base and engage a portion of the base defining the single hole.

* * * * *